US007730927B2

(12) United States Patent
Graichen

(10) Patent No.: US 7,730,927 B2
(45) **Date of Patent: *Jun. 8, 2010**

(54) FRAYLESS FRANGIBLE CONNECTION FOR FABRIC AND VERTICAL BLIND SYSTEM INCORPORATING THE SAME

(75) Inventor: Claus Graichen, Henderson, NC (US)

(73) Assignee: Lace Lastics Co., Inc., Oxford, NC (US)

( * ) Notice: Subject to any disclaimer, the term of this patent is extended or adjusted under 35 U.S.C. 154(b) by 132 days.

This patent is subject to a terminal disclaimer.

(21) Appl. No.: 10/960,533

(22) Filed: Oct. 7, 2004

(65) Prior Publication Data

US 2005/0230060 A1 Oct. 20, 2005

Related U.S. Application Data

(60) Provisional application No. 60/562,333, filed on Apr. 14, 2004.

(51) Int. Cl.
*E06B 3/48* (2006.01)

(52) U.S. Cl. ..... 160/89; 160/84.04; 160/179; 160/236; 160/330; 160/178.1 V

(58) Field of Classification Search ..... 160/84.04, 160/84.05, 89, 89.01; 66/190–199; 139/383 B, 139/384 A; 87/3, 5, 12
See application file for complete search history.

(56) References Cited

U.S. PATENT DOCUMENTS 1,335,627 A * 3/1920 Waterfield ..... 87/10
3,757,541 A * 9/1973 Frohlich et al. ..... 66/193
3,851,699 A 12/1974 Shapiro
3,946,789 A * 3/1976 Ronkholz-Tolle, nee Tolle . 160/168.1 R
4,244,199 A * 1/1981 Rhode ..... 66/193
4,798,200 A * 1/1989 Warthen et al. ..... 602/6
5,297,607 A * 3/1994 Beauchamp ..... 160/84.04

(Continued)

FOREIGN PATENT DOCUMENTS

CA 2090046 A1 8/1994

(Continued)

OTHER PUBLICATIONS

Supplementary European Search Report, dated Mar. 11, 2009.

*Primary Examiner*—Blair M. Johnson
(74) *Attorney, Agent, or Firm*—Amster, Rothstein & Ebenstein LLP

(57) ABSTRACT

A frangible connection for connecting parts of a knitted textile into a single panel is disclosed. The frangible connection is formed of a yarn having a lower tensile strength than that used to knit the parts of the panel so that the parts can be readily disconnected by tearing the frangible connection without damaging the structure of the parts themselves. Thus, a plurality of vertical blind louvers may be knitted into a single panel on a single knitting machine and separated later, preferably prior to installation. Knitted patterns which extend across multiple louvers may thus be practically manufactured without the difficulties in alignment which might be present if each louver were manufactured separately. The frangible connection also functions as a hinge for pivotably connecting the louvers of a combination blind together. The combination blind may consist of alternating opaque louvers and sheer spacers which may be pivoted relative to each other to achieve varying levels of light transmission through the blind.

13 Claims, 21 Drawing Sheets

U.S. PATENT DOCUMENTS

| | | | | |
|---|---|---|---|---|
| 5,603,369 | A * | 2/1997 | Colson et al. | 160/84.06 |
| 5,638,881 | A * | 6/1997 | Ruggles et al. | 160/168.1 V |
| 5,641,560 | A * | 6/1997 | Schmidt et al. | 428/220 |
| 5,797,283 | A * | 8/1998 | Kaczmarczyk | 66/193 |
| 5,878,645 | A * | 3/1999 | Streit | 87/10 |
| 6,453,705 | B2 * | 9/2002 | Fujiwara | 66/176 |
| 6,823,700 | B1 * | 11/2004 | Yi | 66/192 |
| 6,886,368 | B2 * | 5/2005 | Matsuda | 66/192 |
| 7,347,245 | B2 * | 3/2008 | Graichen | 160/89 |
| 7,404,429 | B2 * | 7/2008 | Graichen | 160/89 |
| 2003/0084981 | A1 | 5/2003 | Swiszcz | |
| 2005/0211392 | A1 * | 9/2005 | Elembaby | 160/89 |
| 2005/0230060 | A1 * | 10/2005 | Graichen | 160/168.1 V |
| 2005/0230064 | A1 * | 10/2005 | Graichen | 160/236 |
| 2005/0257898 | A1 * | 11/2005 | Graichen | 160/89 |
| 2006/0021717 | A1 * | 2/2006 | Graichen | 160/168.1 V |
| 2006/0180280 | A1 * | 8/2006 | Graichen | 160/168.1 V |
| 2009/0139664 | A1 * | 6/2009 | Graichen | 160/84.04 |

FOREIGN PATENT DOCUMENTS

| | | |
|---|---|---|
| DE | 20219236 U1 | 3/2003 |

* cited by examiner

FRAYLESS FRANGIBLE CONNECTION FOR FABRIC AND VERTICAL BLIND SYSTEM INCORPORATING THE SAME

RELATED APPLICATIONS

This application claims priority to U.S. Provisional Patent Application Ser. No. 60/562,333, filed Apr. 14, 2004.

FIELD OF THE INVENTION

The present invention relates to a frangible connection knitted into a fabric panel during manufacture. More specifically, the present invention relates to a vertical blind system having decorative louvers which are knitted in a single panel and attached together by a knitted frangible hinge or tear away fringe.

BACKGROUND OF THE INVENTION

When knitting a large fabric panel, it is often the case that the finished fabric will be cut into smaller pieces for use in a finished product, such as a window treatment. The cutting of fabric, however, introduces a number of problems which may present themselves during manufacture, most notably that extra steps are required to cut the fabric accurately. Likewise, by its very nature, cutting interrupts the fabric matrix, leaving a frayed edge which can undermine the strength or appearance of the fabric in the finished product.

In many window or see-through door applications, it is desirable to control the amount of light admitted through the window or see-through door. For instance on sunny days in warm climates, the sun is too strong (and too hot) for the comfort of the occupants, as well as being damaging to interior furnishings that may fade or become brittle. Typically, blinds are fitted, consisting of multiple slats of opaque material that can be individually rotated, in a coordinated manner, to block all or part of the light. When such slats are arrayed horizontally, the assembly is commonly called a "Venetian blind".

In large windows or doors, venetian blinds are impractical because they can become difficult to raise completely when needed for unobstructed viewing, or to clean the glass behind. So, often a variant called a "vertical blind" is fitted, in which rotatable slats are hung vertically from their ends on a traverse mechanism with individual, coordinated rotating hangers. Vertical blinds have been most often used in settings where large windows are more common, such as in commercial buildings or for residential patio doors or picture windows.

Vertical blinds are well known and commonly comprise elongated strips or slats of opaque material suspended vertically from an overhead traverse mechanism provided with individual rotatable hangers. Conventional louvers, also called slats or vanes, of a vertical blind are adapted for lateral movement between a drawn blind position, in which the blind is opened to one or opposite ends of a traverse or channel adjacent their tops and an extended blind position wherein the louvers are positioned in generally equal spaced relation to one another along the length of the traverse or channel.

The louvers themselves are also adapted for selective rotation about their longitudinal axes between open and closed positions. The spacing between the louvers when the blind is extended is approximately equal to their width. Thus, when the traverse mechanism is positioned, for example, above and along the horizontal length of a window, the rotation of the louvers selectively blocks the passage of light through the window.

The vertical louvers may be made of vinyl or other suitable material, colored to add an accent color to the room or colored to blend with the primary color of the room. These louvers are generally limited to solid colors, or simple vertical patterns, because they are manufactured separately. If a continuous horizontal pattern effect is attempted using this method, it is prohibitively difficult accurately to align sequential louvers horizontally. Each louver in a horizontal pattern represents an individual pattern segment even slight misalignment of which would be unattractively obvious and would destroy the aesthetic appeal of the blind.

The louvers may also be made or covered with a fabric material to achieve a specific design effect. Louvers formed entirely of fabric may lack the rigidity of solid louvers, and thus may be provided with a hanger reinforcement at the top and a weight on the bottom to permit the louvers to hang uniformly.

Currently, fabric blind louvers are manufactured from continuous rolls of louver-width fabric that have been slit from wider fabric rolls. These are individually cut to length and sewn to form a louver. This production method makes the incorporation of a horizontal pattern prohibitively difficult because there is no way to assure that pattern elements will align horizontally. Even if the louvers were cut transversely from rolls of patterned fabric having a width equal to the length of the louver, further processing such as the attachment of mounting hardware to each of the louvers would introduce sufficient vertical error into each louver to destroy the horizontal alignment of the pattern.

Fabric louvers manufactured from a single roll of fabric have an additional drawback in the tendency of the louvers to fray along their longitudinal edges, particularly as a result of machine washing. Because the material from which the louvers are cut necessarily has an existing continuous structure, the cutting of which necessarily presents edges where the structure has been interrupted, resulting in a series of loose threads. Untreated, these threads tend to unravel, weakening the fabric and creating an unattractive frayed edge over time and as laundered. Preventing this result requires additional costly manufacturing steps.

It is also known to combine a vertical blind with a sheer fabric wherein the opaque vertical slats of the blind cooperate with the sheer fabric to provide diffusion of the light entering between the opaque slats when the blind has been extended and is in the open position. This provides an aesthetically pleasing effect, as well as adding privacy as a result of reduction in the clarity of view from the exterior into the interior of the building.

U.S. Pat. No. 5,638,880 to Colson et al. discloses such a combination vertical blind wherein rigid opaque vanes having the arrangement of a conventional vertical blind are attached at one of their longitudinal edges a sheet of sheer fabric such that light passing between the slats of the blind passes through the sheer fabric when the blind is open. Such a blind can be expensive to manufacture, as the sheer fabric must be attached to the vanes during an additional manufacturing step because the vanes are made of a different material from the fabric. Furthermore, although the width of a conventional vertical blind can be adjusted by adding or removing a number of discreet vanes, this is not possible in a combination blind because the vanes are essentially connected together into a single structure by the sheer fabric, requiring these blinds to be custom made to a specific width, also adding to their expense.

Another example of a combination blind is disclosed in U.S. Pat. No. 3,851,669 to Shapiro. Shapiro is directed to a drape adapted to be supported in the manner of a vertical blind and having alternate opaque and sheer vertical sections. The opaque sections are generally rigid and may be selectively rotated to permit the transmission of light through the sheer sections or to block the transmission of light by folding the sheer sections over the opaque sections. One obvious drawback, in addition to the drawbacks discussed with respect to Colson et al. above, is that the rigid vanes overlap the fabric requiring excessive fabric in order to fabricate the entire window covering. Further, the vanes or louvers are only attached to the fabric material along a top and bottom edge thereof, thereby inhibiting the control over the fabric material during operation of the window covering.

Another embodiment disclosed by Shapiro is a blind having alternating opaque and sheer sections in which the generally rigid vertically extending louvers are eliminated and substituted by a fabric panel having alternate vertical sections of fine and coarse mesh. The fine mesh sections may be provided with stiffening members at a top hem thereof and are connected to a vertical blind traverse from which the fine mesh sections may be rotated as louvers. When in the open position, the coarse mesh sections are disposed so as to admit a maximum of light therethrough. When in the closed position, the fine mesh sections are rotated so that the edges thereof overlap adjacent fine mesh sections to impede the transmission of light. Although this embodiment overcomes some of the limitations of the first Shapiro embodiment, a disadvantage of such a blind would be due to the lack of stiffness of the fine mesh "louver" sections. Any attempt to rotate the louvers of the second Shapiro embodiment would be resisted progressively along the length of the louver, resulting in an unattractive, non-uniform twisting which would render the blind nonfunctional.

Therefore a need exists for a vertical blind which can display a pattern horizontally across its louvers such that the alignment of the pattern from one louver to the next occurs without noticeable misalignment.

A further need exists for a vertical blind having louvers formed entirely of fabric, said louvers having an independent knitted structure wherein the major seams are substantially uninterrupted and free of loose thread ends, and wherein said louvers can be machine washed without developing frayed seams.

A still further need exists for a combination blind comprising a panel of fabric combining sheer and light-blocking sections, said blinds having sections of sufficient rigidity to function as louvers and a structure which allows the louvers to uniformly adjust to vary the amount of light which passes through the sheer sections of the blind, without the need for stiff louver panels.

A still further need exists for a fabric combination blind which can be produced in a standard width which can be adjusted easily as needed during installation over non-standard windows.

SUMMARY OF THE INVENTION

The invention seeks to resolve these problems and satisfy these needs by proposing a frayless frangible connection which permits the knitting of multiple components of a vertical blind from a single fabric panel.

In accordance with an embodiment of the present invention, a vertical blind is provided having a plurality of rectangular fabric louvers which are manufactured as a complete set for a particular width installation. The louvers are manufactured together in a single panel, attached together at their longitudinal margins by a frangible seam which can be torn without damaging the louvers, to separate the individual louvers prior to installation. In the event that the width of the installation calls for more louvers than can be fabricated into a single panel, multiple panels of louvers can be used. Conversely, in the event that fewer louvers are needed, the surplus can be discarded.

According to an aspect of this embodiment of the present invention, a continuous horizontal pattern may be provided across the panel during manufacture. As the louvers in the panel are attached together during manufacture, vertical alignment of the pattern from one louver to the next can be maintained, resulting in a horizontal pattern that remains aligned after separation and installation of the louvers.

According to another aspect of this embodiment of the present invention, each louver may have a knitted structure which is independent of the structure of the other louvers. This permits the provision of an edge stitch along the longitudinal margins of the louvers, preventing them from fraying particularly during machine washing.

According to another aspect of this embodiment of the present invention, the edge stitches of the louvers may be formed of a high tenacity yarn. Similarly, the frangible connection between the louvers may be formed by a connector yarn having a lower tensile strength than that of the high tenacity yarn which connects adjacent louvers together. This structure provides a connection between the louvers that can be torn away without damage the knitted structure of the louvers.

According to yet another aspect of this embodiment of the present invention, fold and sew lines can be provided within the knitted structure of each louver to provide for the attachment at precise, repeatable locations of a hanger at the top of each louver and a weight at the bottom thereof. Similarly, a slot may be knitted into the structure of the louver to accommodate the attachment of a hook to the hanger.

In accordance with a second embodiment of the present invention, a combination blind is provided having alternating substantially opaque fabric louvers and sheer transparent or translucent fabric spacers, each of the spacers connecting together a spaced apart pair of the louvers. The louvers may be provided with a hanger at the top for pivotably supporting the louvers from a traverse, and may have a weight at the bottom to bias the louvers vertically. The traverse permits pivotal movement of the louvers between a closed and an open orientation.

In the closed orientation, the louvers are generally parallel and in a common plane which lies generally in the plane of the blind itself. The lateral edges of the louvers are in contact, thus blocking the passage of light through the blind. The spacers extend alternately in the same plane immediately behind and in front of the louvers. In the open orientation, the louvers are generally transverse to the first common plane, and parallel to one another. The spacers, however, extend between the louvers parallel to the common plane, permitting the passage of light through the spacers.

The blind may also be drawn to one or both sides of the traverse, the spacers collapsing, folding over or forming an arc as the louvers, parallel to each other and oriented transversely to the plane of the blind, are drawn together.

According to an aspect of the second embodiment of the present invention, the combination blind is provided with stitched hinges along the lateral edges joining the fabric louvers to the sheer spacers. The stitching of the hinges ideally provides minimal contact between the louvers and the spacers, to provide an interface between these components that is more flexible than the stitching which comprises the fabric of the louvers and spacers themselves. This flexibility between the louvers and spacers permits the components of the blind to move relative to one another at the hinges without causing flexing of the louvers or spacers inward of the hinge, particularly during opening and closing of the extended blind. Alternately, or in addition, the yarn from which the hinges are stitched may itself have greater flexibility than that used to form the fabric of the louvers and spacers of the blind.

According to another aspect of the second embodiment of the present invention, the louvers, spacers and hinges of the blind may be formed in a single knitting operation, on a single knitting machine. The machine is ideally capable of knitting multiple yarns simultaneously, and the blind is ideally knitted in a single panel having a sufficient number of louvers connected by spacers for an entire blind.

According to yet another aspect of the second embodiment of the present invention, the hinges may also serve as frangible connections between the louvers and spacers of the blind. Ideally, the hinge is formed of a yarn having a lower tensile strength than that of the surrounding fabric, thereby permitting a spacer to be torn away by hand from a louver at the hinge between them without damaging the structure of either the louver or the spacer. Thus, a blind that may have been manufactured to a standard width and is too large for a particular installation may be adjusted during installation. Preferably, the hinge is stitched to release completely from the louver when torn to prevent the lateral edge from appearing frayed.

According to another aspect of the second embodiment of the present invention, the blind panel may be provided with an attachment strip connected to one or both of the louvers or spacers at each end of the blind, to provide a terminus for attachment together of multiple blind panels in the event that installation of a wider blind is called for.

Ideally, the attachment strip may be a narrow extension preferably attached by a frangible hinge to a lateral edge of the blind panel. Thus, the frangible hinge may provide a means to remove the attachment strip if it is not needed without damage to the blind, and may function as a hinge if attached to another panel. Advantageously, adhesive coated yarn may be used in the attachment strip, or alternatively, an adhesive may be applied to the attachment strip after manufacture. Preferably, the adhesive may be activated by heat to permit the panels to be attached together using a conventional iron. Advantageously, the attachment strip is knitted in a pattern which will blend seamlessly into the blind panel to which it is attached.

According to still another aspect of the second embodiment of the present invention, a continuous horizontal pattern may be provided across the panel during manufacture. As the louvers in the panel are attached together during manufacture, and remain together after installation, vertical alignment of the pattern from one louver to the next can be maintained. The pattern may extend across both the opaque louvers and the sheer spacers, so that a pattern is visible both when the extended blind is open (revealing the sheer sections only) or closed (revealing the louvers). Ideally, any pattern on the sheer sections should be stitched so as to be suitably transparent when the blind is closed even from those spacers which pass over a louver when closed.

According to another aspect of the second embodiment of the present invention, intermediate hinges may be provided longitudinally in the sheer spacers, between and parallel to the frangible hinges between the spacers and adjoining louvers. The intermediate hinges permit each spacer to fold along the hinge when the blind is drawn. Ideally, the intermediate hinges are formed in the same manner and with the same yarn as the frangible hinges on either lateral edges. This simplifies manufacturing, and ensures a similar degree of flexibility in all of the hinges. Alternatively, because the intermediate hinges are not intended to be torn away, they may be formed of a different, stronger, yarn, or may be stitched differently from the frangible hinges at the lateral edges of the spacers to make the hinge more resistant to tearing.

According to yet another aspect of the second embodiment of the present invention, the frangible and intermediate hinges may be biased to fold in a particular direction. Selection of the yarn used in the hinges, as well as treatments applied to the hinges during and after manufacturing, may advantageously be modified to provide a bias which assists the sheer spacers to fold in a particular orientation.

According to another aspect of the second embodiment of the present invention, the blind may be converted from a combination blind to a conventional vertical blind by removing the spacers from the louvers by tearing the frangible hinges. After conversion, the spacers may be discarded as the conversion process cannot be reversed.

According to an aspect of each of the embodiments of the present invention, multiple panels of blinds can be manufactured sequentially on a single knitting machine. Multiple panels may be advantageous when a particular blind is called for that exceeds the width of a single-panel blind, particularly when a horizontal pattern is called for which extends across more than one panel. Additionally, other components of a vertical blind may be knitted into a panel such as a valance which may be secured by a frayless frangible connection by which the valance can be removed from the panel without damage to the remaining parts of the blind.

According to another aspect of each of the embodiments of the present invention, the individual louvers may be sequentially numbered to provide an indication to the user of the hanging order of the louvers in the event that they are removed from the blind temporarily, as when they are washed. The numbers are preferably inscribed into the louvers in a location that is not normally visible, such as at the top where the louvers are typically blocked by a valance. An arrow may also be inscribed to indicate the orientation of the louver. Louver numbering is particularly important for the conventional vertical blind embodiment, particularly if the blind has a horizontal pattern. However, louver numbering is also of use in the combination blind of the present invention in the event that a combination blind is converted into a conventional blind.

Other aspects, features, and details of the present invention can be more completely understood by reference to the following detailed description of the preferred embodiments, taken in conjunction with the drawings, and from the appended claims.

DESCRIPTION OF THE PREFERRED EMBODIMENTS

Figure 1:
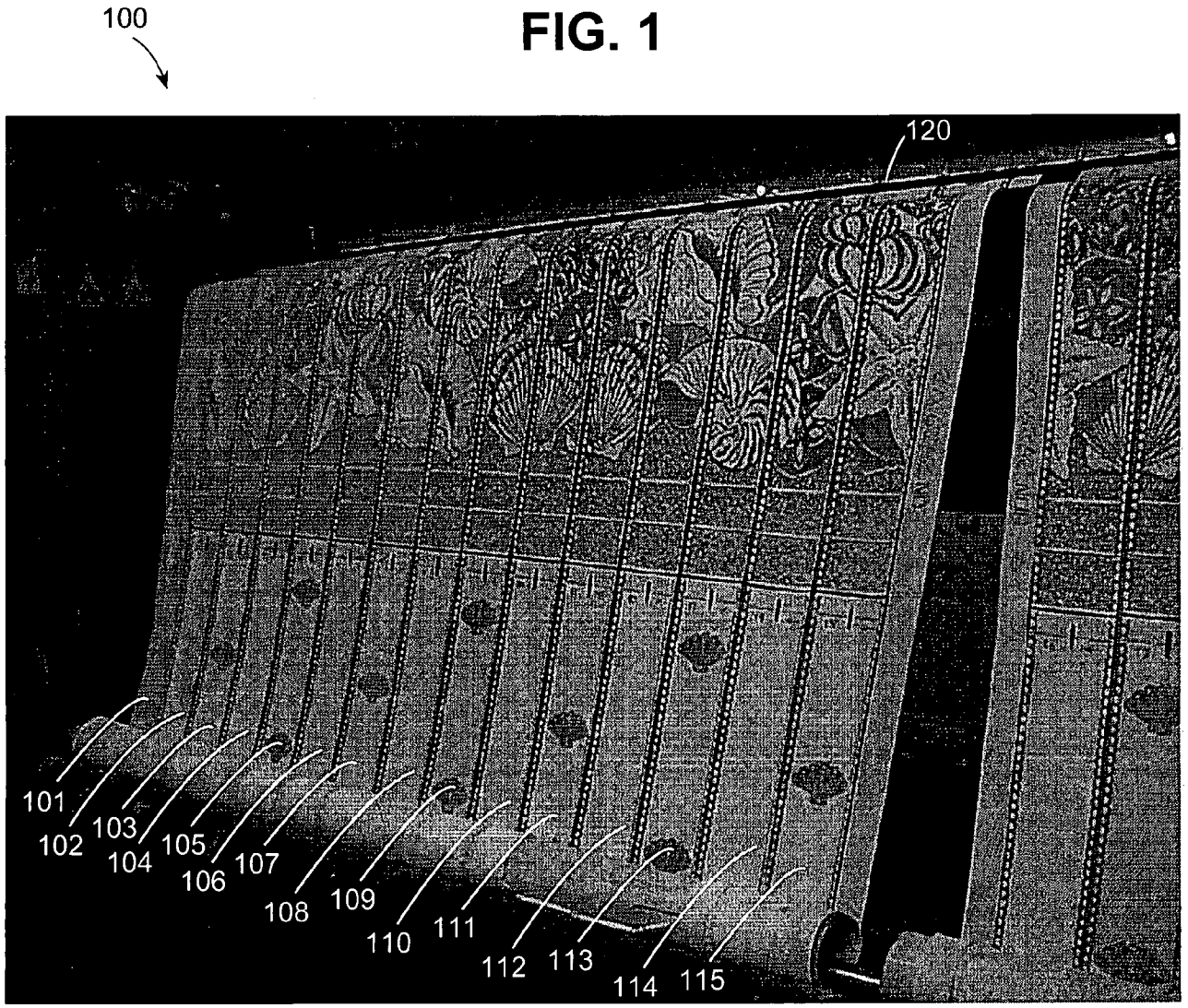
FIG. 1 is a front perspective view of an embodiment of a vertical blind incorporating the present invention, partially rolled around a tube.

An arrangement of a first embodiment of a vertical blind incorporating the present invention is shown in FIG. 1. FIG. 1 illustrates a single fabric panel 100 comprising fifteen louvers of a vertical blind 101-115. This window treatment has a pattern 120 that spans the width of the panel. As illustrated, the design continues from one louver to the next. The individual louvers for this window treatment have been knit in a single panel to be separated after they are finished, as described below, assuring an accurate alignment of the pattern when installed. Each of louvers 101-115 are separated by a tear away fringe, which enables the louvers to be separated for installation.

Figure 2:
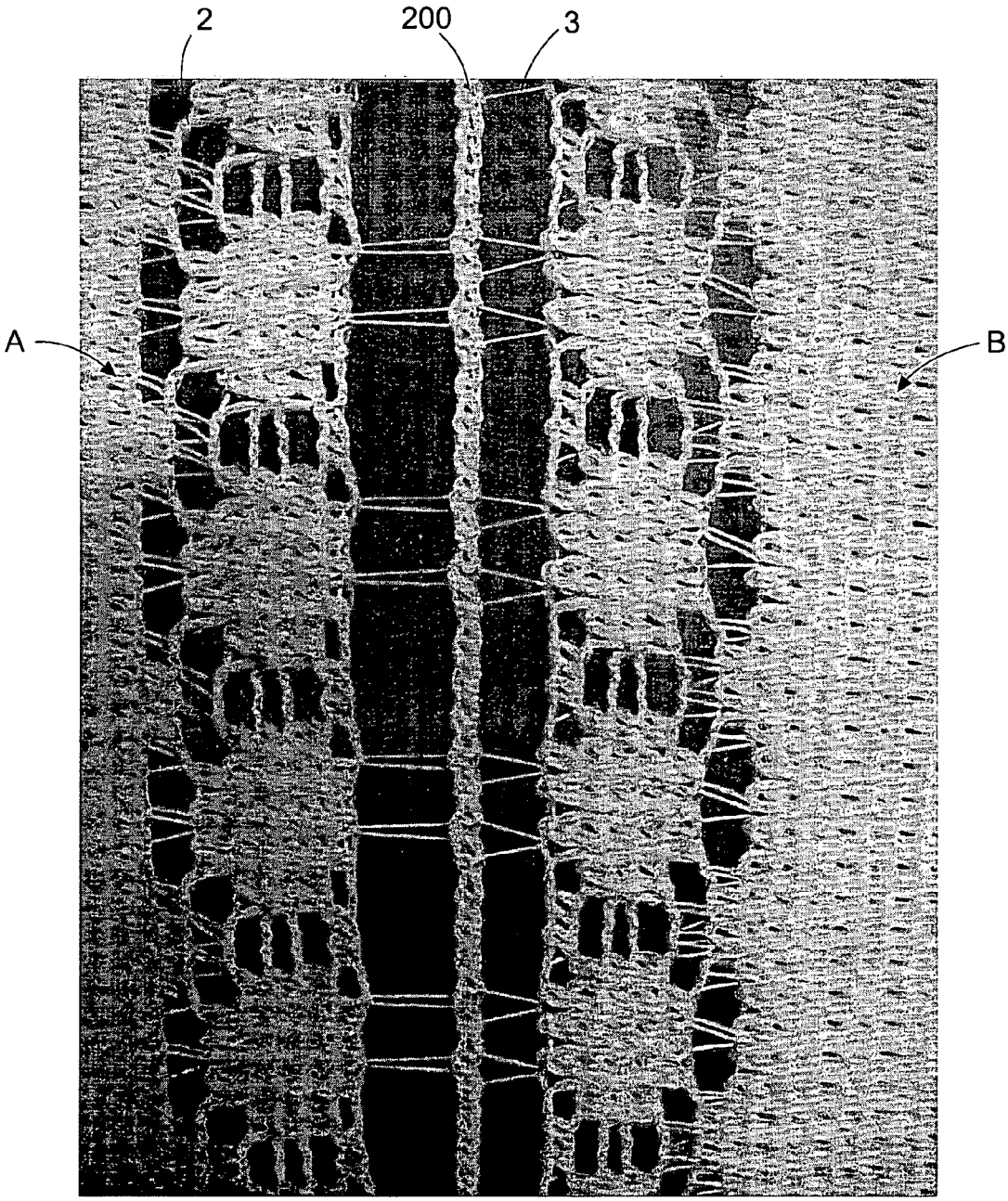
FIG. 2 is a plan view of the construction details of the tear-away fringe of the present invention.

FIG. 2 is a detail of the tear away fringe 200 of the present invention. The tear away fringe 200 is shown running vertically between two adjacent louvers A and B. Connector yarns 2 and 3 are shown connecting tear away fringe 200 to the edge of louvers A and B respectively. Prior to installation of the louvers, tear away fringe 200 is pulled away to separate louvers A and B. Connector threads 2 and 3 attaching louvers A and B to fringe 200 will pull away with the fringe leaving a clean edge as described below with respect to FIG. 3.

Figure 3:
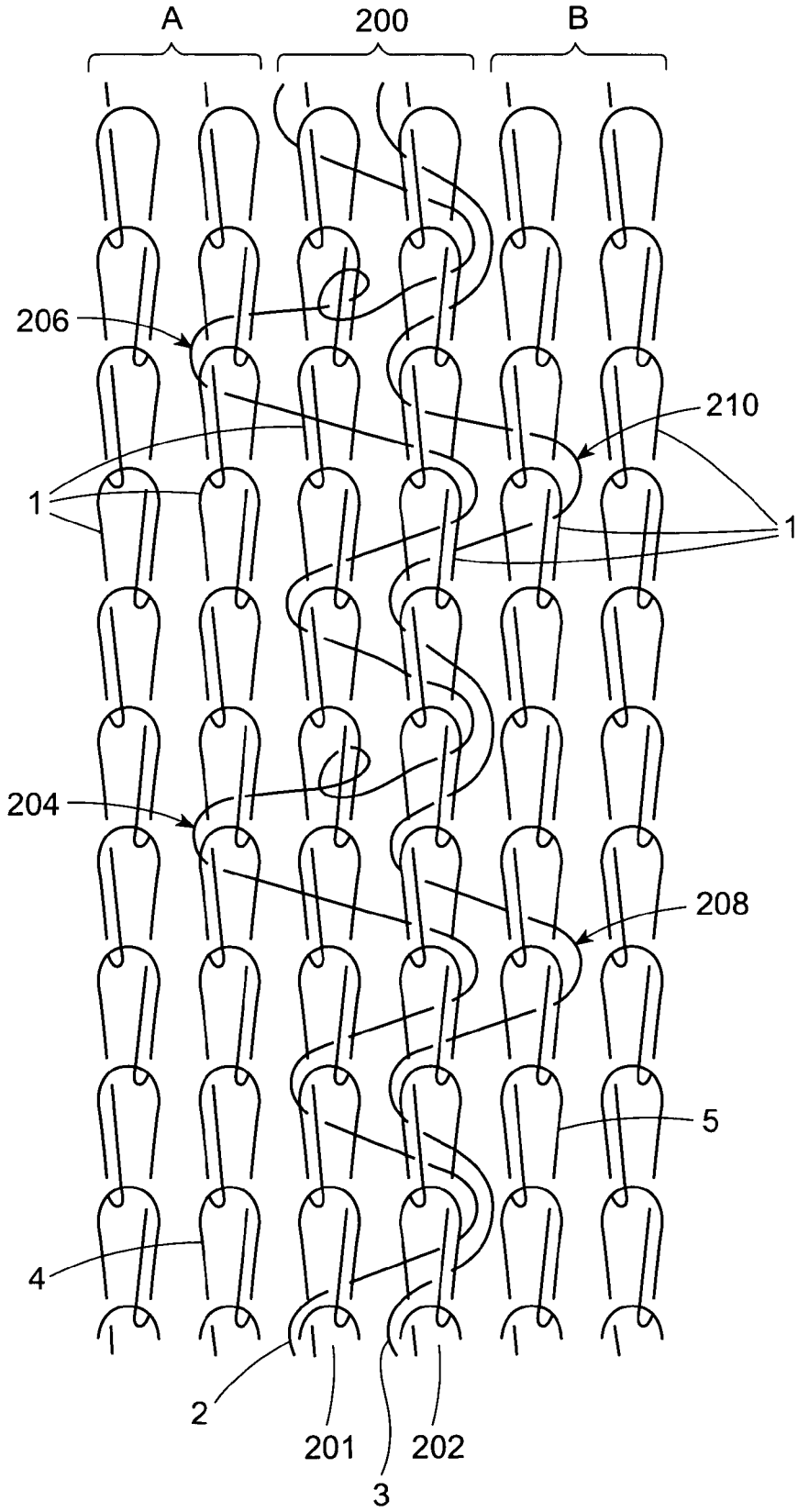
FIG. 3 is a schematic representation of the tear-away fringe of the present invention.

FIG. 3 is a schematic representation of the tear-away fringe of FIG. 2. pillar stitches 1 run vertically through the fabric, parallel to each other for the width of the entire panel. For example, in the panel of FIG. 1, the vertically extending pillars would continue to the left and right of panel 120 across the entire width of the panel. Preferably, pillar stitches 1 are formed of a high tenacity polyester yarn. Pillar stitches 1 form the basis of the structure of the fabric of panel 120. In the preferred embodiment, pillars 1 are the stitches to which all other yarns attach to form a fabric. As shown, pillar stitches 4 and 5 represent the edge stitch of louvers A and B respectively, pillar stitch 4 being the right most edge of louver A and pillar stitch 5 being the left most edge of louver B. As noted above, FIG. 3 illustrates only two pillar stitches of each louver, although in a preferred embodiment, a louver is formed for example of 30 or more pillar stitches.

Tear-away fringe 200, by contrast, is formed of 2 pillar stitches 201 and 202, said pillar stitches preferably being identical in structure to the pillar stitches that comprise louvers A and B. Connector yarns 2 and 3 are shown respectively linking pillars 4 and 5 to tear-away fringe 200. Connector yarns 2 and 3 continue in a generally vertical direction through tear-away fringe 200, and in a set pattern traverse between tear-away fringe 200 and pillar stitches 4 and 5.

Specifically, as shown in FIG. 3, connector yarn 2 traverses between pillar stitches 201 and 202 and traverses between tear away fringe 200 and pillar stitch 4 at locations 204 and 206. Similarly, connector yarn 3 traverses between tear away fringe 200 and pillar stitch 5 at locations 208 and 210. By contrast to connector yarn 2, however, connector yarn 3 does not traverse both pillars 201 and 202 of tear away fringe 200, but rather traverses only between pillar stitches 202 and 5. It is not critical that one or more of connector yarns 2 and 3 traverse between pillar stitches 201 and 202, however, the connector yarns 2 and 3 must traverse respectively at least one of the pillar stitches of louvers A and B, preferably the edge pillar stitches thereof, as the connector yarns 2 and 3 are the only connection between louvers A and B and tear-away fringe 200. Hence, connector yarns 2 and 3 are the only connection with attaches louvers A and B together.

Figure 4:
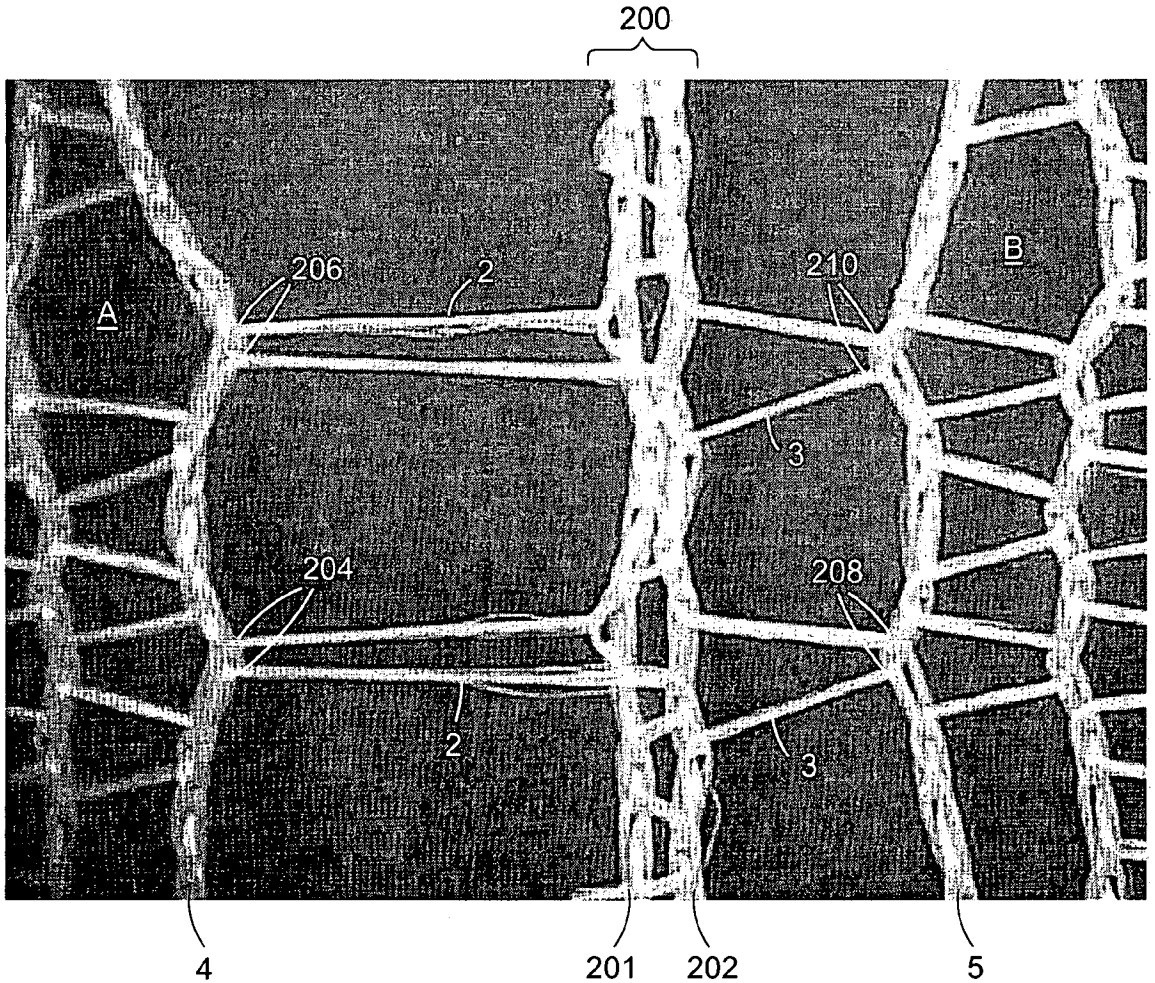
FIG. 4 is a plan view of the construction details of the tear-away fringe of the present invention.

Ideally, connector yarns 2 and 3 are formed of a filament-type yarn, having a lower tensile strength than the high tenacity polyester yarn used to form pillar stitches 1. FIG. 4 shows in greater detail the location of the pillar stitches and connector yarns forming tear-away fringe 200 between louvers A and B.

Figure 5:
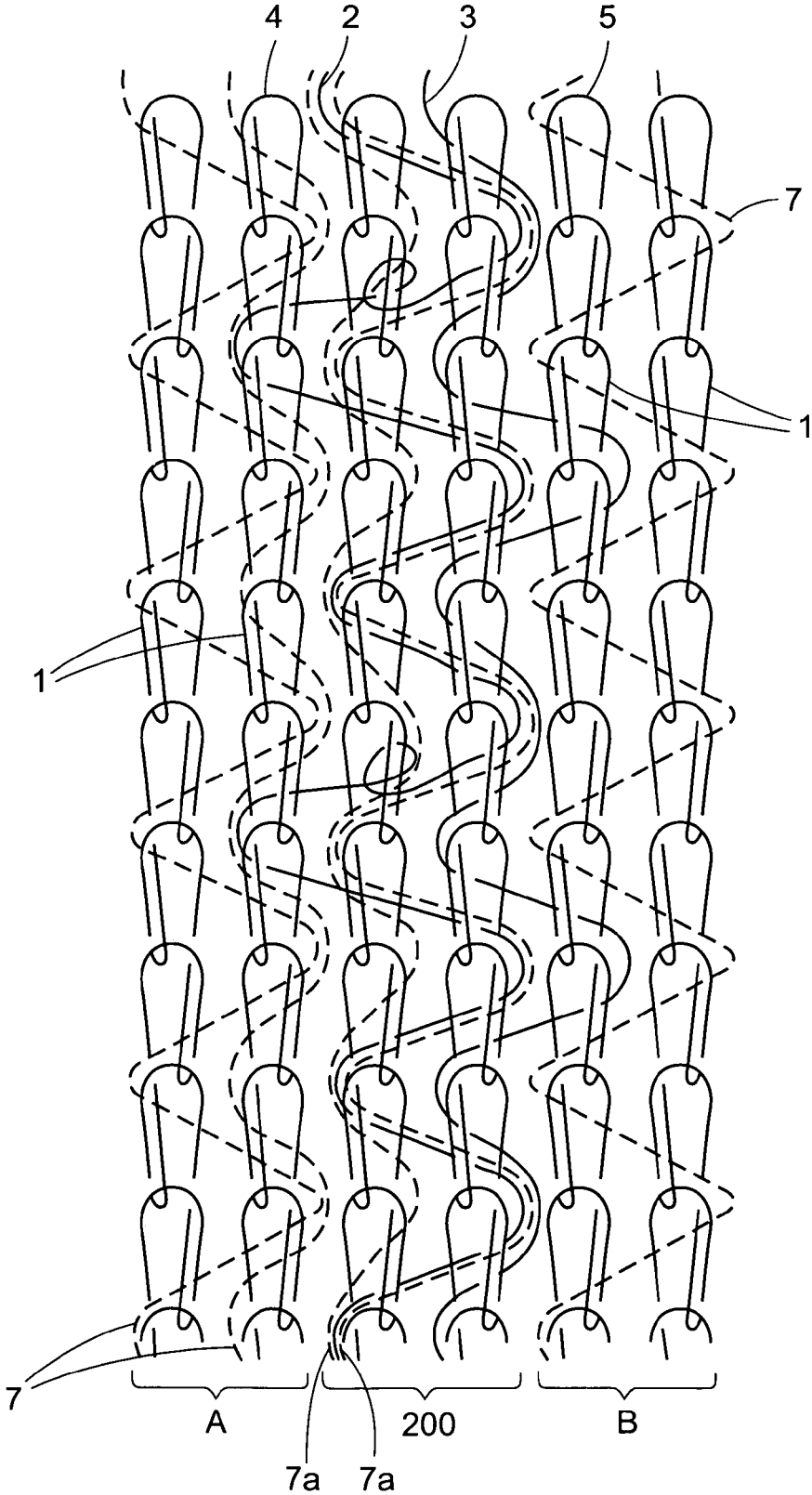
FIG. 5 is a schematic representation of an embodiment of the tear-away fringe of the present invention.

FIG. 5 is a schematic diagram similar to FIG. 3, indicating a possible traverse of additional pattern yarns 7, shown in dotted lines, relative to connector yarns 2 and 3 in tear away fringe 200. Pattern yarns 7 are used to traverse between the pillar stitches 1 of louvers A and B only. It is these pattern yarns 7 that give louvers A and B their strength and opacity. However, it is critical that the pattern yarns not traverse into tear away fringe 200. Instead, tear-away fringe 200 may have pattern yarns 7*a*, 7*a* to increase the strength of the tear-away fringe, although pattern yarns 7*a*, 7*a* similarly do not traverse into the pillar stitches which comprise louvers A or B.

In order to separate louvers A and B, tear away fringe 200 is pulled out of the fabric. Connector yarns 2 and 3, having a lower tensile strength than the surrounding pillar stitches, will break, causing louvers A and B to become disconnected. In a preferred embodiment, connector yarn 2 and 3 is more intimately intertwined with pillar stitches 201 and 202 and is only minimally intertwined with pillar stitches 4 and 5. As a result, the broken remnants of connector yarns 2 and 3 are more likely to remain lodged in tear away fringe 200 when torn from the fabric. This is advantageous, as tear away fringe 200 is discarded whereas louvers A and B remain free of loose yarn fragments and are immediately ready for use. An additional advantage accrues from the structure of louvers A and B which, due to the independent pillar stitches 1 which comprise them, are not weakened as a result of the removal of the connector yarns 2 and 3. On the contrary, the connector yarns are superfluous with respect to the structure of the louvers, and serve only to connect the louvers together into a single panel. This independent structure results in a clean edge that will not fray over time or as a result, for example, of machine washing.

As a result of attaching a set of louvers from a single vertical blind into a unitary fabric panel as shown in FIG. 1, the knitting of a horizontal design across the panels is greatly simplified as the panels can be manufactured simultaneously, and control over the horizontal alignment, and length of the panels can be made uniform. The result is a vertical blind which has a continuous appearance and attractively displays a horizontal pattern.

Figure 6:
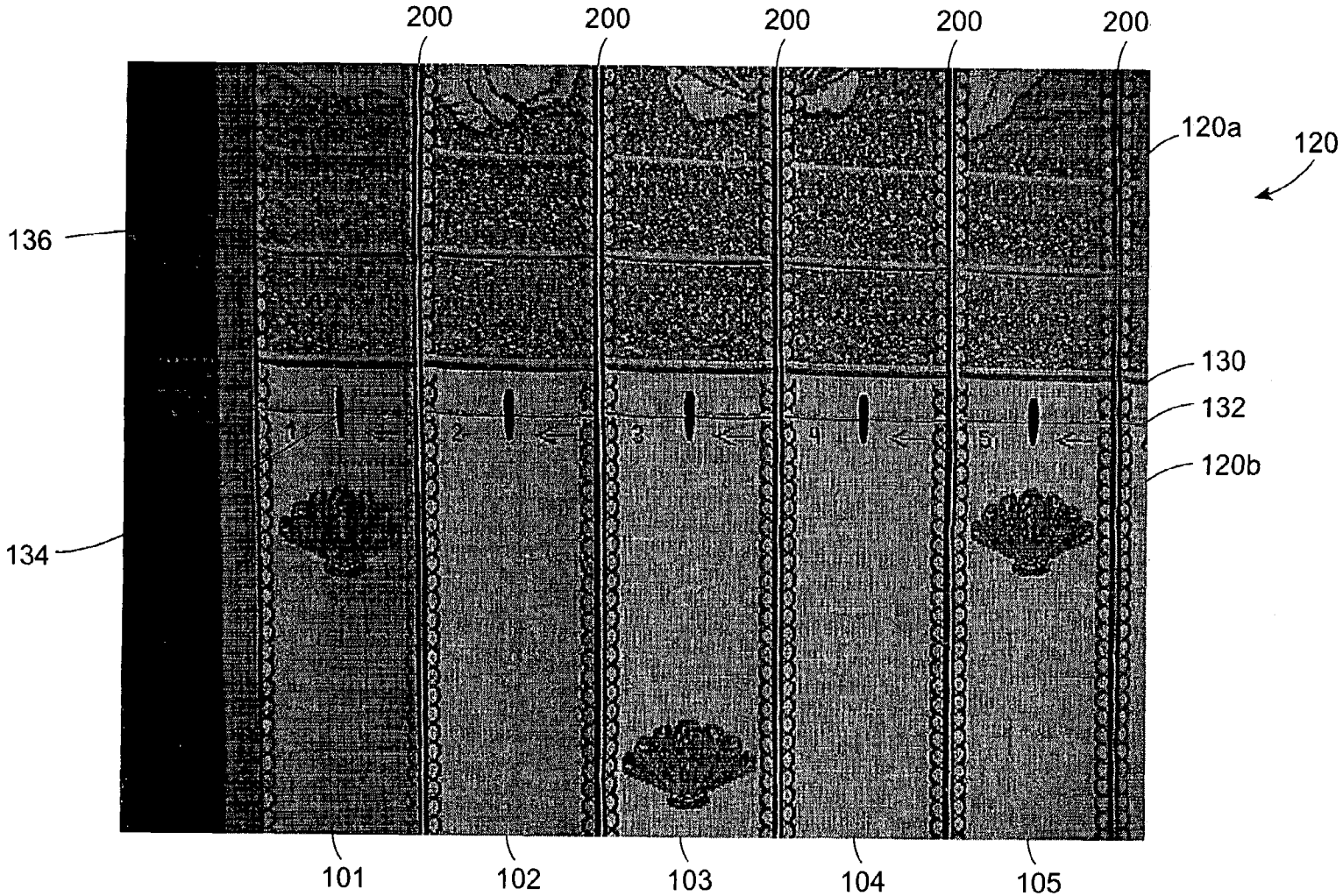
FIG. 6 is a fragmentary plan view of a fabric panel incorporating the present invention.

As shown in FIG. 6, a section of panel 120 is shown at the cutting line between the bottom of panel 120A and the top of panel 120B. Specifically, panels 101 through 105 are shown bordered by horizontal line 130 which divides the panels 120A and 120B. Tear away fringes 200 are also visible which demarcate the end of one louver and the start of another. Fold line 132 indicates where the top of louvers 101 through 105 are folded to allow for the insertion of hangers or mounting hardware, not shown. Holes on 134 may optionally be provided to allow for a mounting hook to pass through the louvers. Line 136 on the bottom, indicates fold and sew points for bottom weights which may optionally be provided to improve the performance of the louvers.

The installation of bottom weights and top hangers ideally takes place after knitting of the panels is complete, but prior to delivery of the finished blind to a consumer. Installation of the various hardware does not require separation of louvers 102 through 105 from each other, although the indication of a unique louver No. which is knitted into each of louvers 101 through 105 simplifies the installation of the blind, even if the louvers are separated prior to delivery to the consumer. Further, sequential numbering of the louvers in this manner permits the blind to be disassembled, for example, for the purpose of washing the louvers, without risk that the correct sequence of the louvers will not be known when the blind is reassembled.

Figure 7:
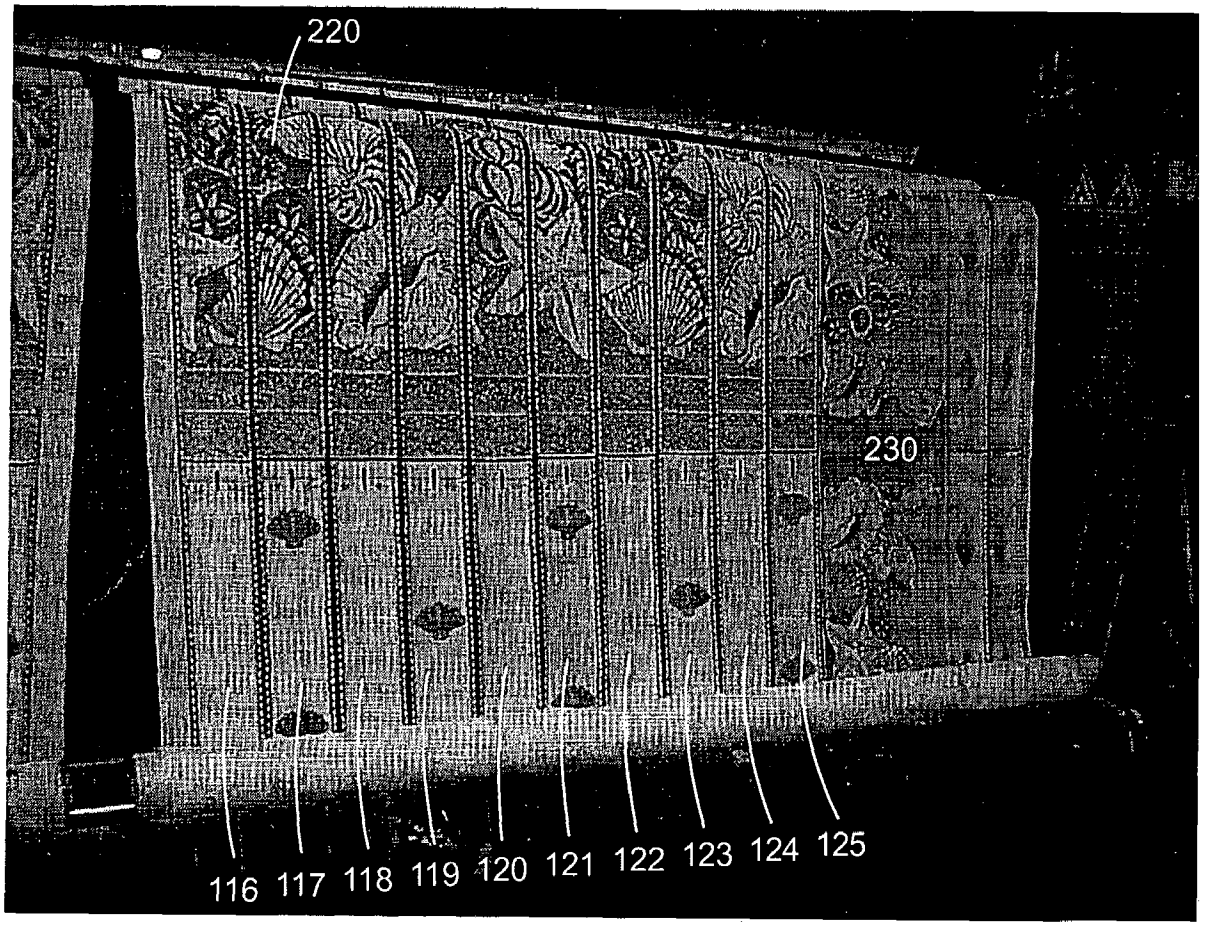
FIG. 7 is a perspective view of a fabric panel which includes the louvers and valance of a vertical blind incorporating the present invention partially rolled around a tube.

Ideally, a single panel of louvers is manufactured to sufficient width to accommodate the number of louvers required for a single blind. However, if the particular application calls for a blind having more louvers than can practicably be knitted into a single panel, continuation panels having the required number of louvers to complete the blind may be manufactured. As shown in FIG. 7, continuation panel 220 is shown in which louver 116 to 125 are manufactured. The louvers of continuation panel 120 are fabricated in the same manner as louvers 101-115, in that they are provided with horizontal fold and sew lines and are vertically divided by a tear away fringe. Furthermore, if a continuous horizontal pattern is provided in a previous panel, continuation panel 220 can incorporate a continuation of that horizontal pattern as shown in FIG. 7.

Additionally, components such as a valance may also be knitted into a continuation panel 220, for example when there is insufficient space on a previous panel to incorporate a valance. The valance 230 is knitted into continuation panel 220 ideally in the same manner as the individual louvers, specifically, by a tear away fringe which can be pulled away from panel 220 to separate valance 230.

During installation of a vertical blind comprising louvers fabricated on two separate panels, small discrepancies in horizontal alignment may develop between the panels due to normal variations in the knitting process. The results would be a small horizontal offset between the louvers of one panel and the louvers of another in the blind. A significant discrepancy would be immediately visible, particularly when a continuous horizontal pattern is provided across the louvers of the blind.

Dimensional variations occur naturally in the knitting process, and are the results of many factors such as machine tension, variations in yarns and ambient factory conditions. Dimensional drift of this kind typically occurs over the course of a manufacturing run in a gradual manner from the beginning of the run to its end. Therefore, the first panel produced during a manufacturing run is likely to deviate only slightly from the second or third panel in a run, whereas differences between the first and last panels are likely to be more significant. As a result, the panels in a multiple panel blind should be produced during the same manufacturing run, preferably so that each continuation panel is manufactured immediately after the preceding panel.

An arrangement of a second embodiment of a vertical blind incorporating the present invention is shown in FIGS. 8A-8D. FIGS. 9A-9D correspond generally to FIGS. 8A-8D and show a schematic representation of the operation of the blind of the second embodiment. Blind 300 is a combination blind having alternating substantially opaque fabric louvers 310 and sheer transparent or translucent fabric spacers 320, each of spacers 320 connecting together a spaced apart pair of louvers 310. The louvers may be provided with a hanger 330 at the top for pivotable support of louvers 310 from a traverse 332 and may have a weight at the bottom (not shown) to bias the louvers vertically. Traverse 332 permits pivotable movement of louvers 310 between an open and a closed orientation.

Figure 8A:
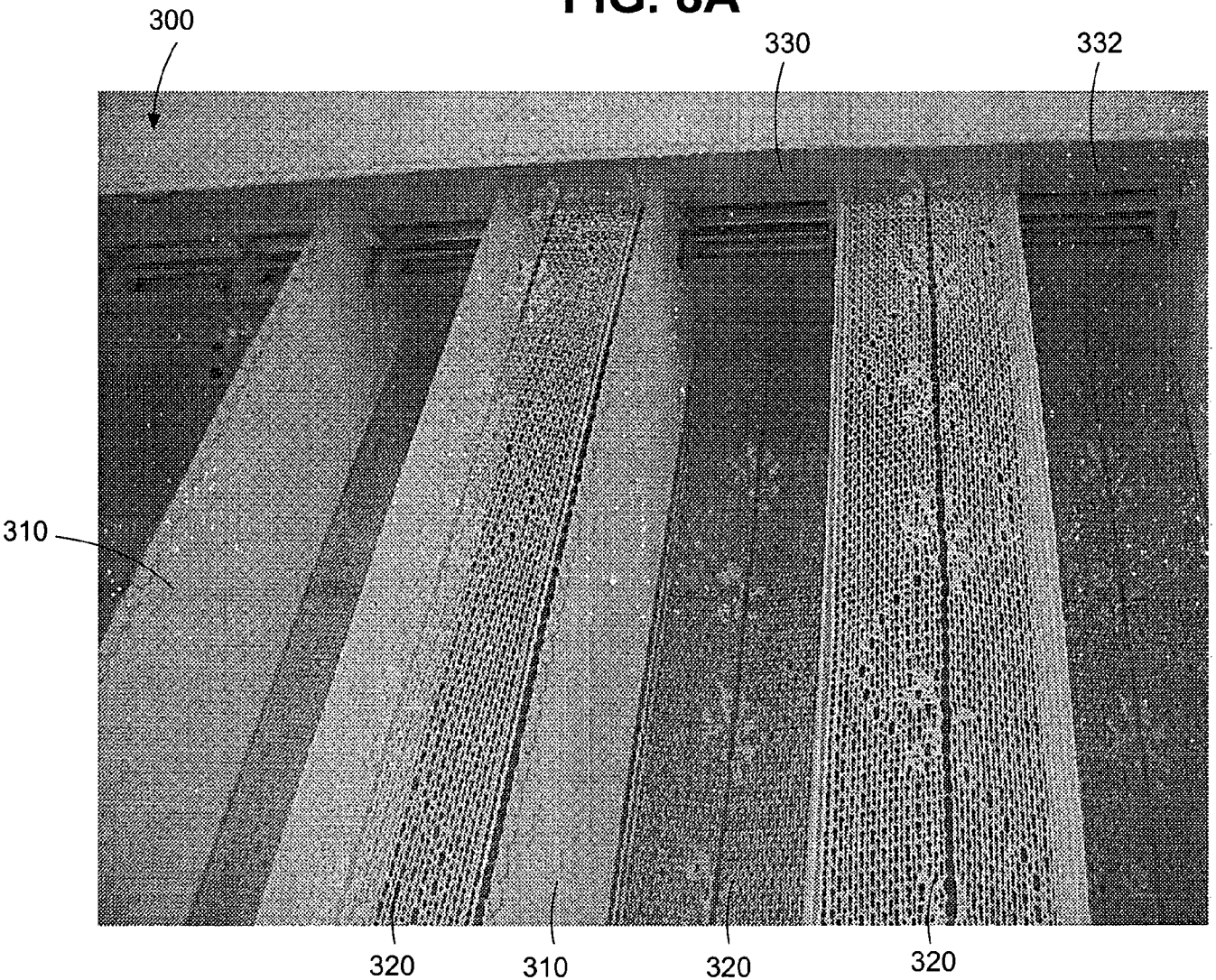
FIGS. 8*a* through 8*d* are bottom perspective views of an embodiment of a combination blind incorporating the frangible hinges of the present invention.
Figure 9A:
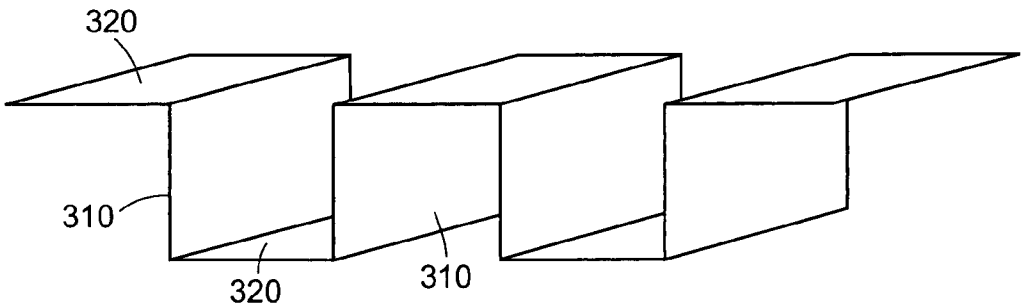
FIGS. 9*a* through 9*d* are graphical representations of the combination blind of the present invention.

FIGS. 8A and 9A illustrate the open orientation, wherein louvers 310 are generally transverse to traverse 332 and parallel to one another. Spacers 320 are generally parallel to another, extending horizontally between louvers 310, alternatively in one of two common planes parallel to traverse 332. Spacers 320 permit the passage of light therethrough, whereas the transverse orientation of opaque louvers 310 allows light to pass.

Figure 8B:
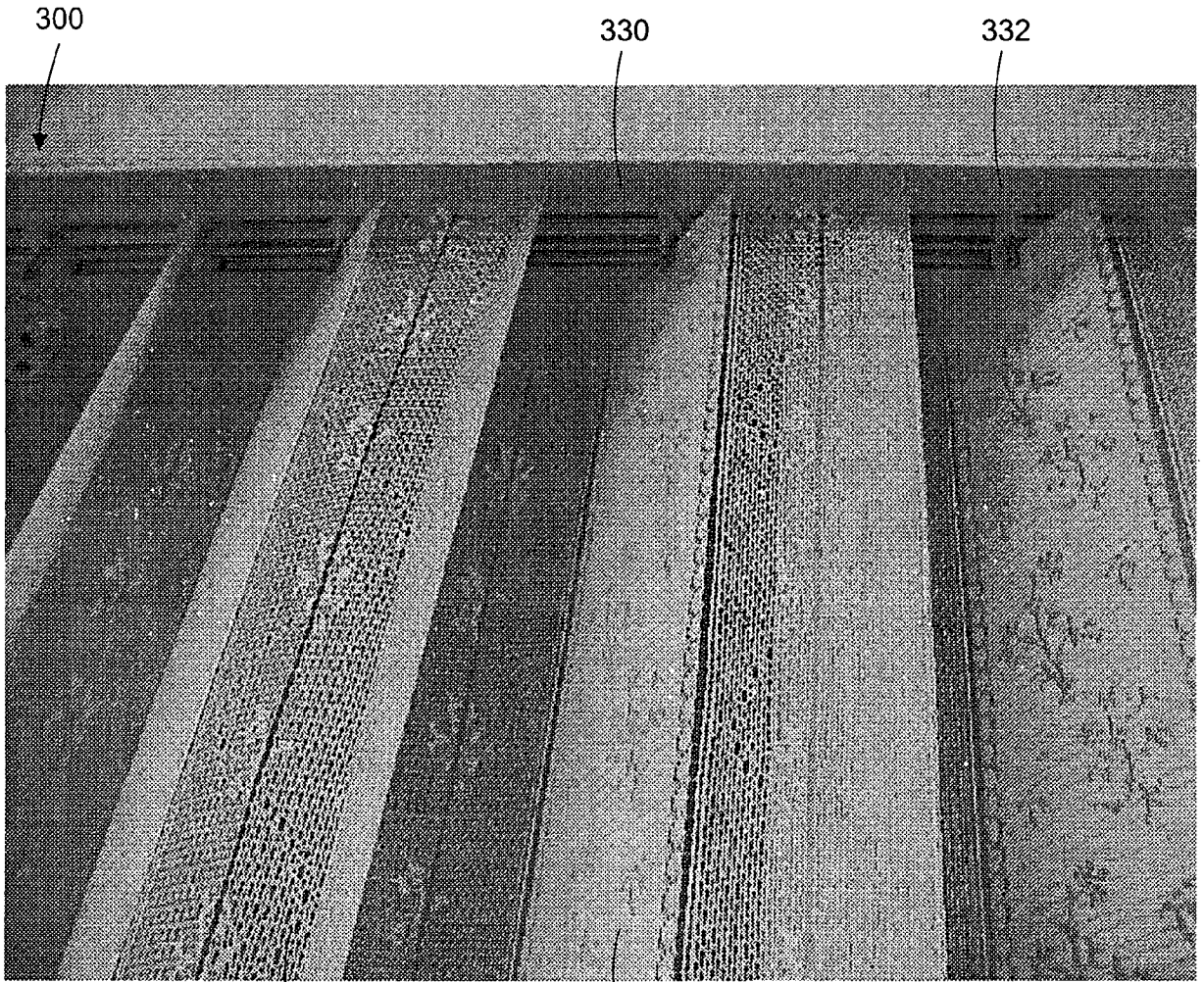
Figure 9B:
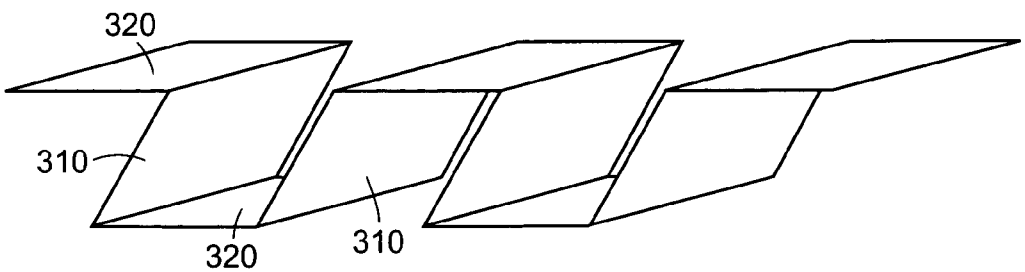

FIGS. 8B and 9B illustrate the blind of the present invention in a partially closed orientation. Louvers 310 have been rotated at hooks 330 to deviate from the transverse orientation that defines the open position. Although louvers 310 are still parallel, having been rotated in unison, there is now a partial blockage of light due to the angle of louvers 310. Similarly, spacers 320 are only partially blocked, therefore admitting some light, albeit less than in the open position.

Figure 8C:
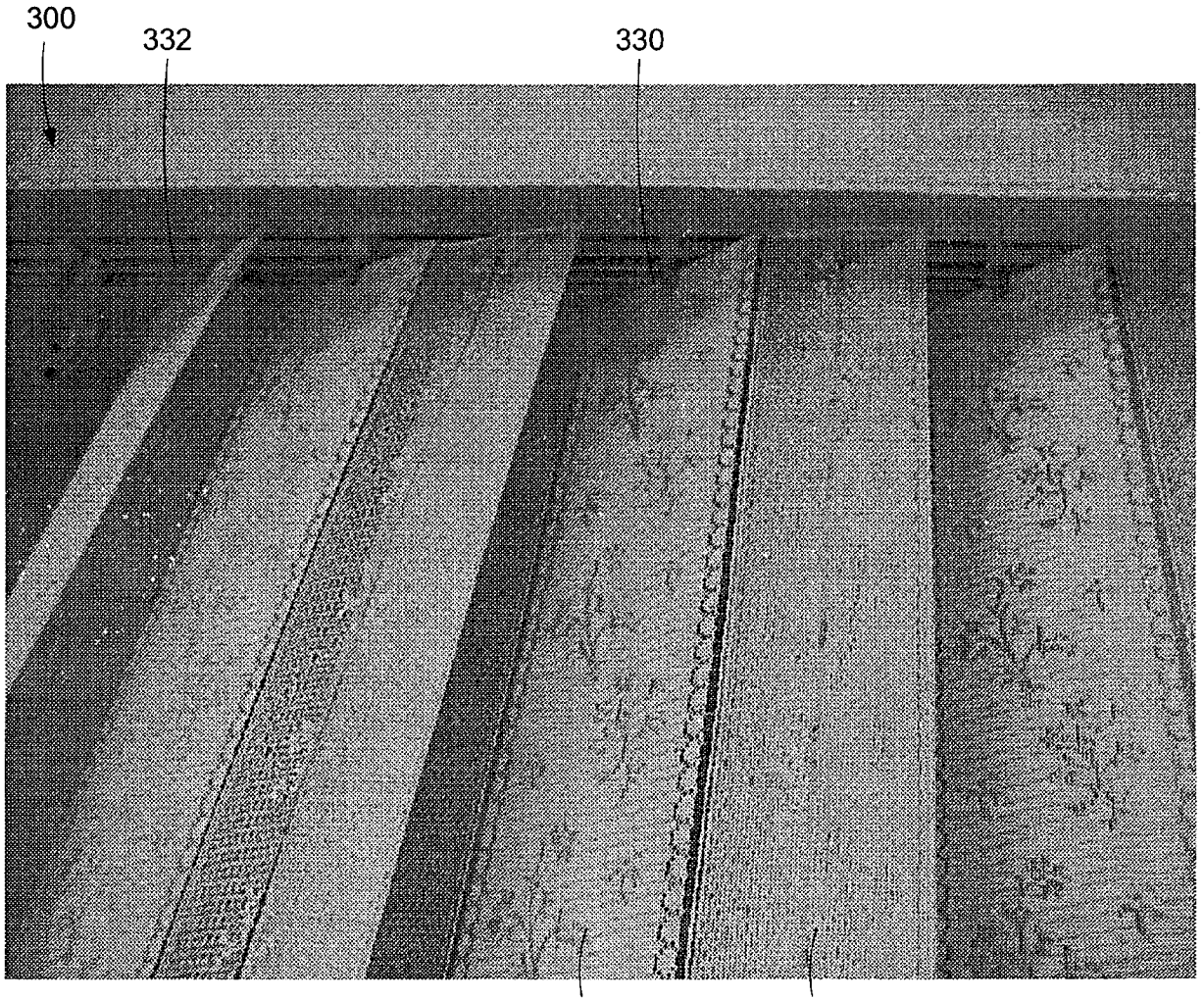
Figure 9C:
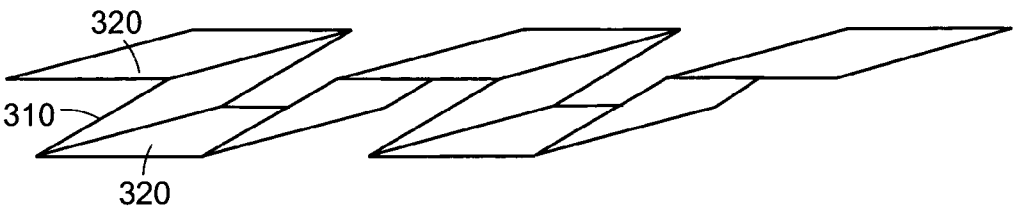

FIGS. 8*c* and 9*c* illustrate a further closing of blind 300. In this position, louvers 310 have been rotated still further from their original transverse orientation, thus blocking more light. Louvers 310 are still parallel, although they are now nearly parallel to traverse 332, revealing the patterns on the surface of louvers 310. Similarly, spacers 320, while still admitting some light, are nearly blocked by the action of louvers 310.

Figure 8D:
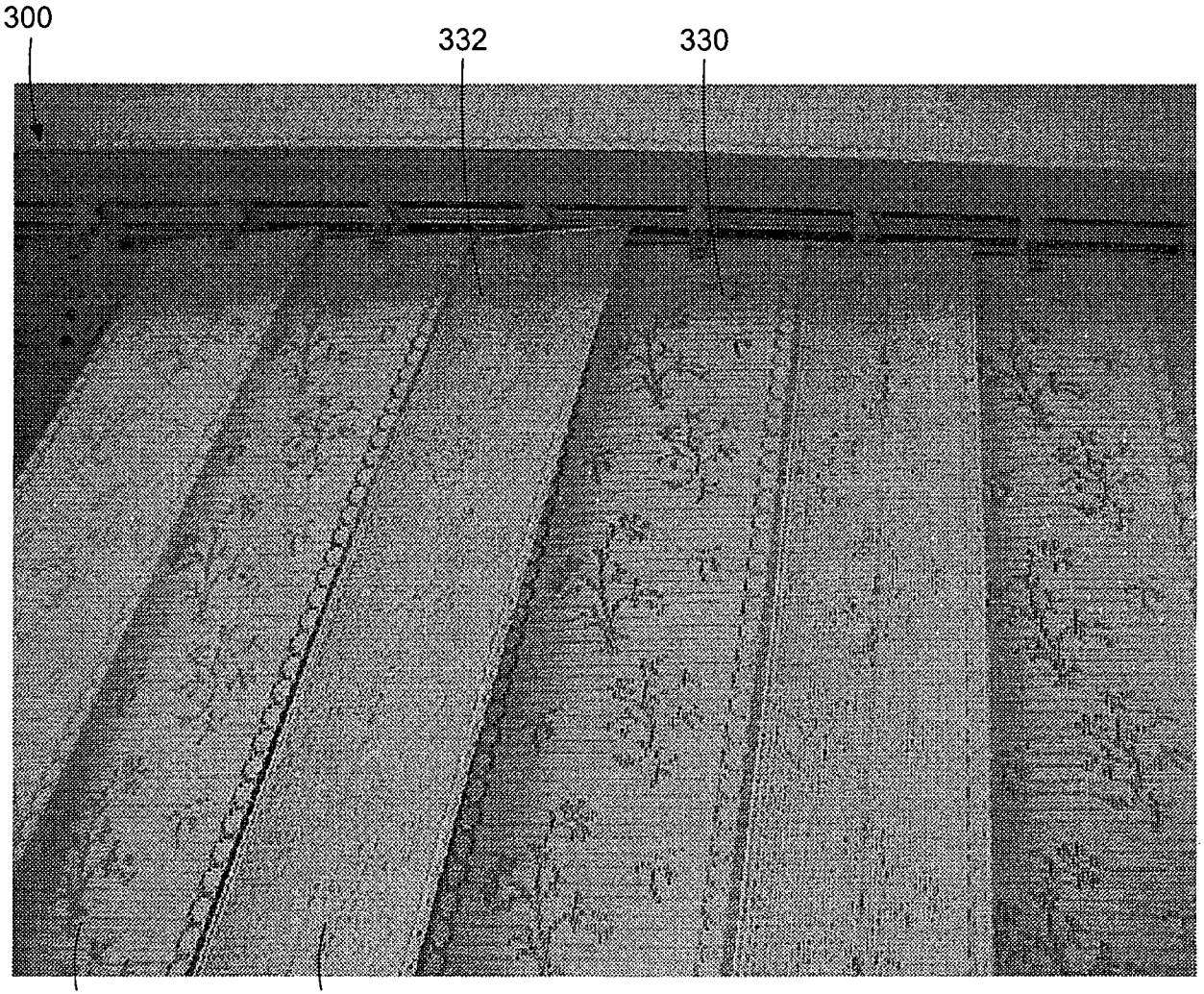
Figure 9D:
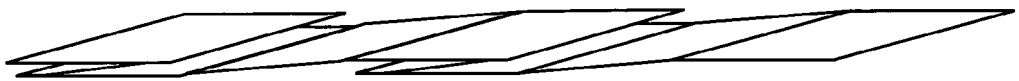

FIGS. 8*d* and 9*d* illustrate blind 300 in a completely closed orientation. Louvers 310 have been rotated 90° from their original, transverse orientation, and are now parallel to traverse 332. The distance between louvers 310 is less than or equal to their width, therefore louvers 310 overlap, substantially completely blocking the passage of light therethrough. Spacers 320 are still visible over alternate louvers 310, although no light passes through spacers 320 due to the positioning of louvers 310.

Figure 10A:
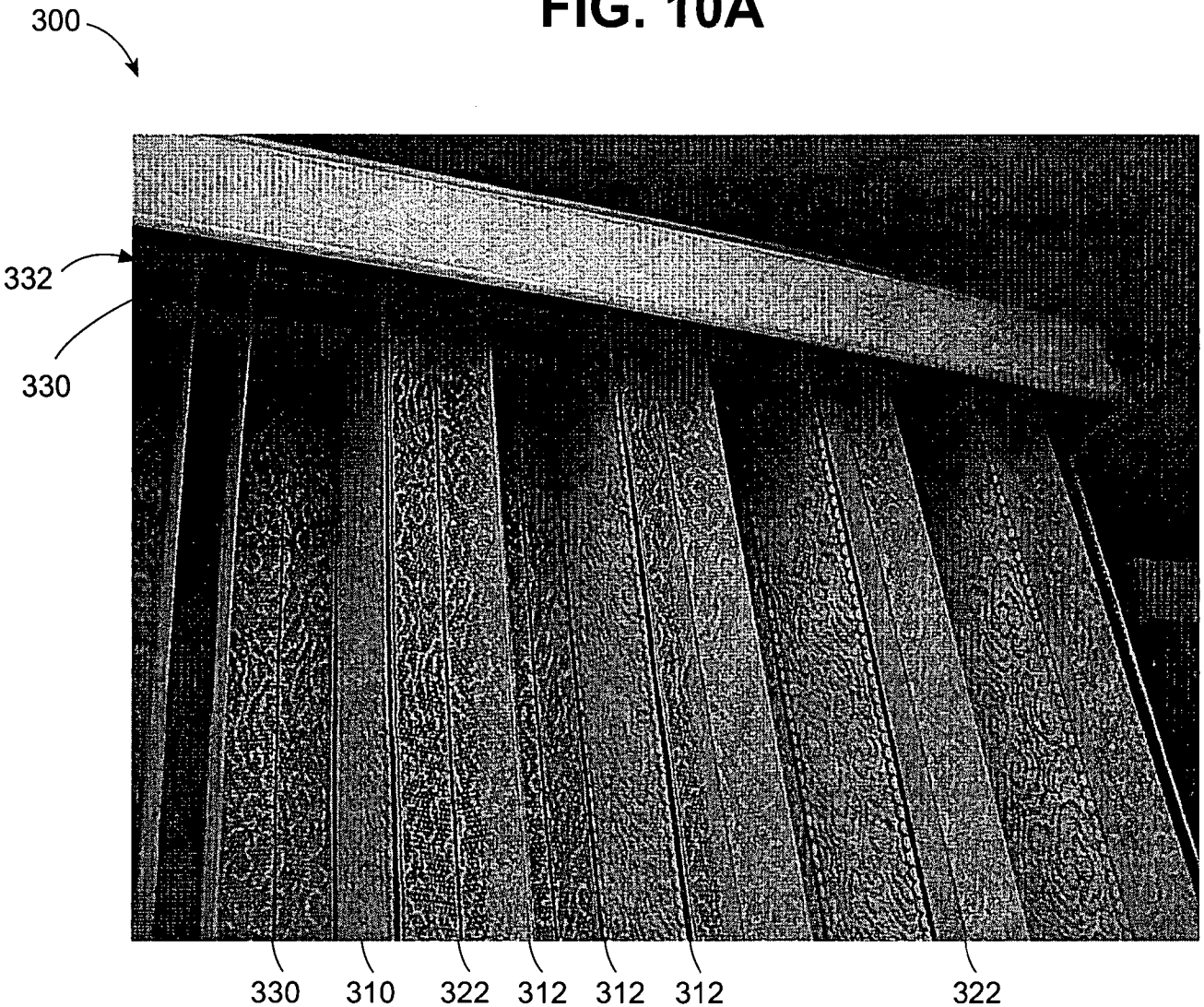
FIGS. 10*a* through 10*c* are partial bottom perspective views demonstrating the function of the frangible hinges of the present invention as incorporated in a combination blind.
Figure 10B:
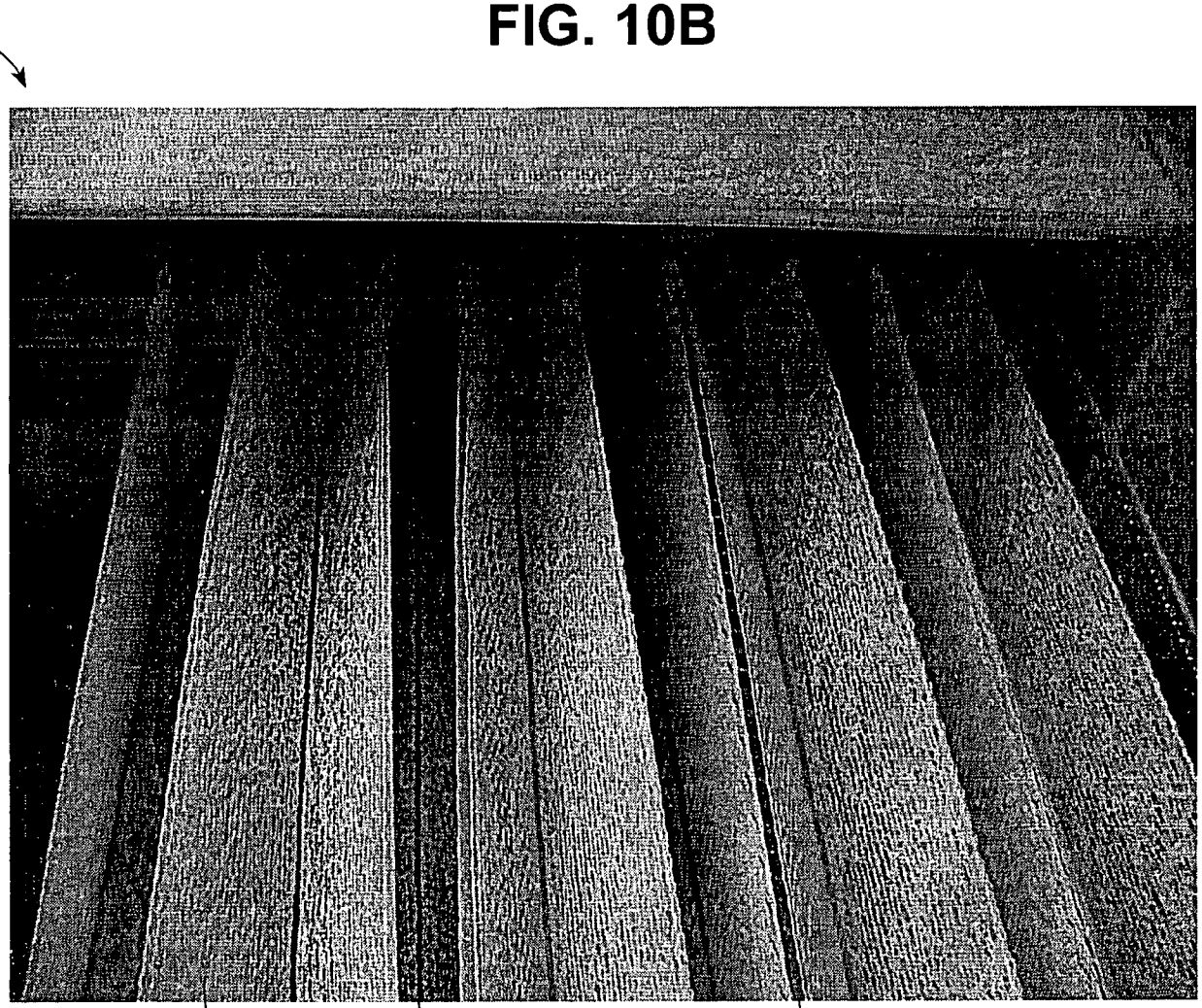
Figure 10C:
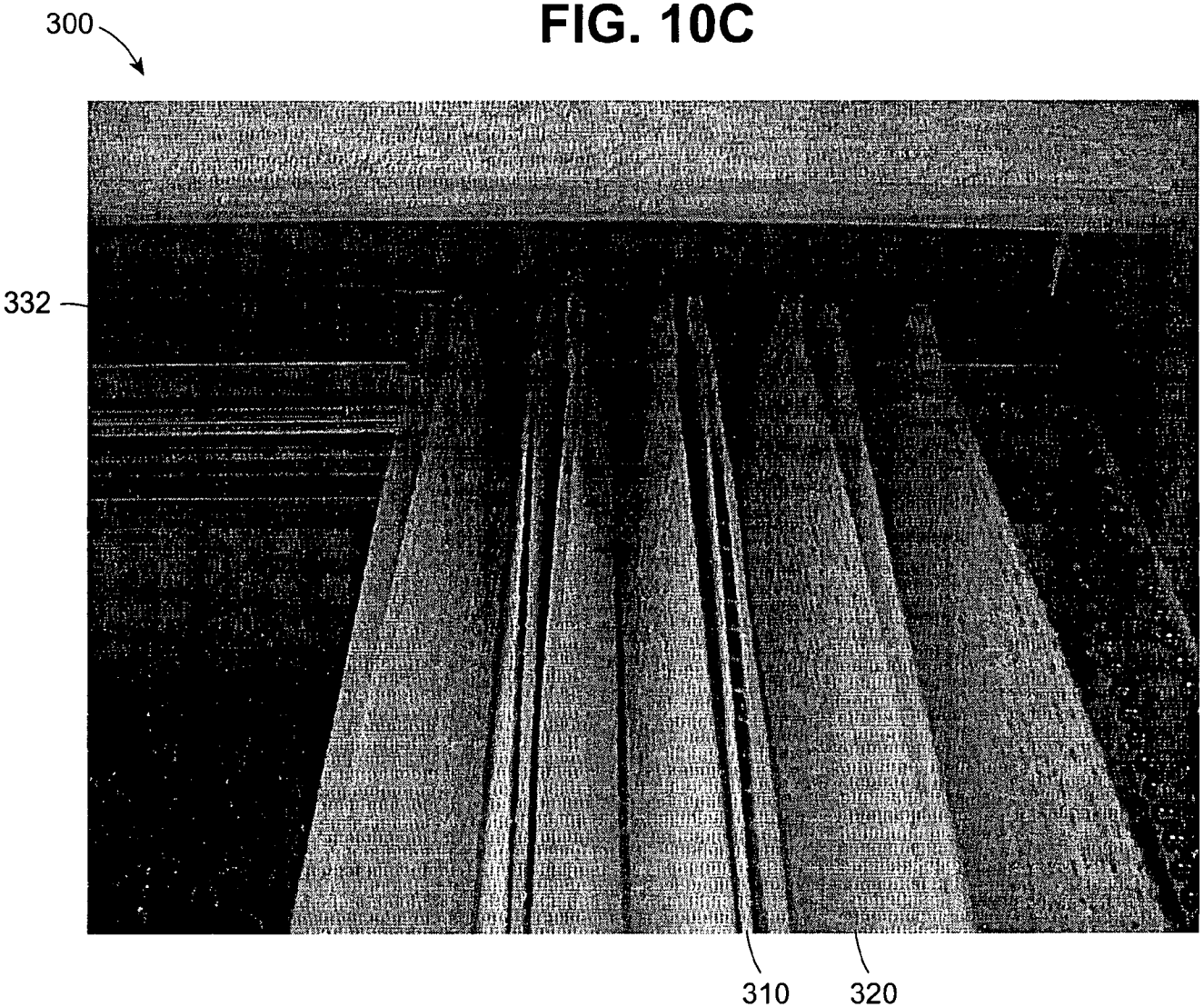

Blind 300 may also be drawn to one or both sides of traverse 332 as shown in FIGS. 10*a* through 10*c*. 10*a* illustrates line 300 fully extended with louvers 310 in the open position. Hinges 312 between louvers 310 and spacers 320 are shown as well as intermediate hinge 322.

FIG. 10*b* illustrates line 300 shown partially drawn to one side. The operation of frangible hinges 312 and 322 is visible as spacers 320 fold in an inward direction as line 300 is drawn. FIG. 10*c* illustrates line 300 completely drawn to the side, to the mechanical limit of traverse 332, illustrating the manner in which louvers 310 and spacers 320 fold against each other.

Figure 11:
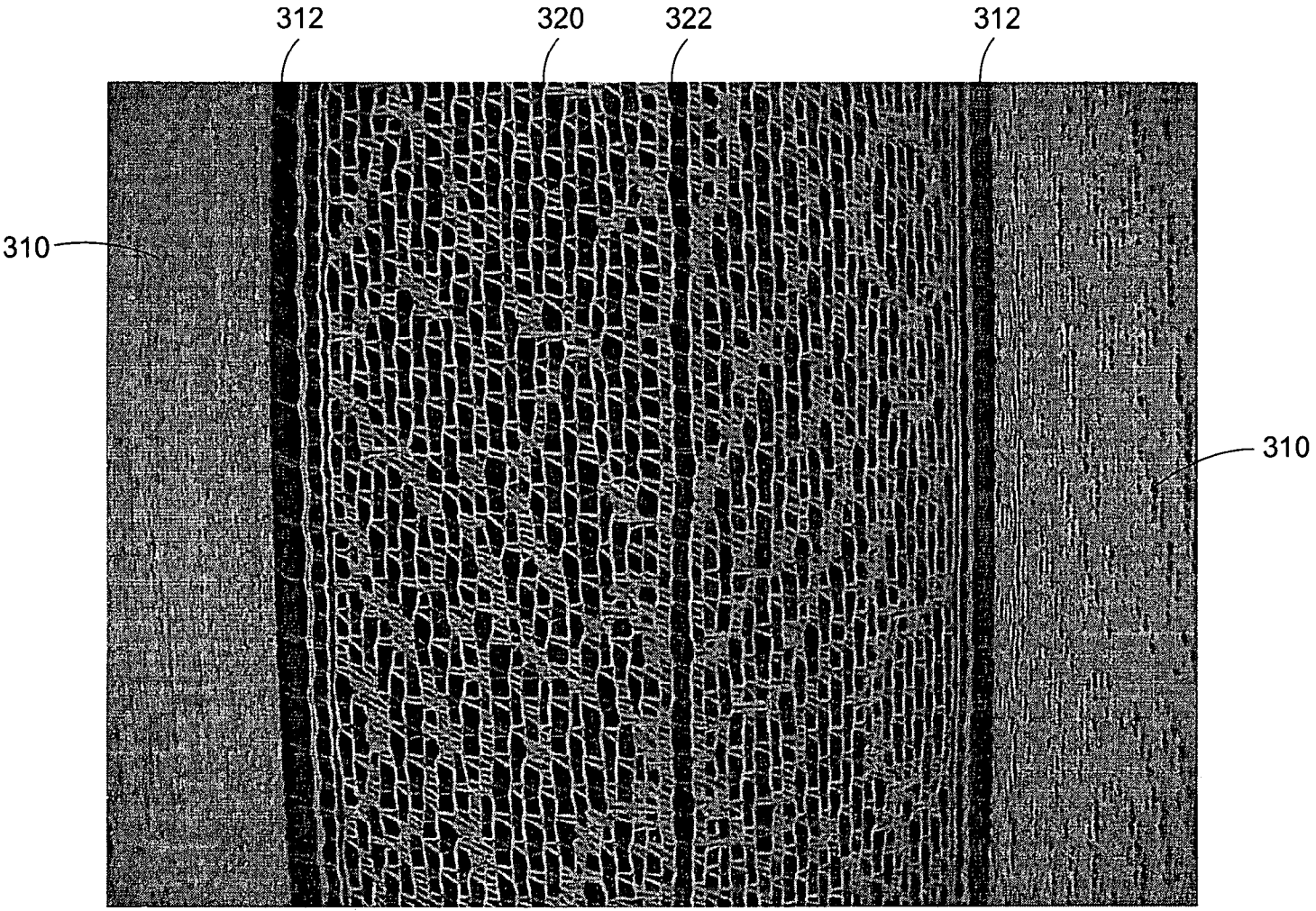
FIG. 11 is a partial plan view of a section of a combination blind of the present invention.

FIG. 11 illustrates the hinging mechanism of the present invention in greater detail. Spacer 320 is shown attached by hinges 312 to louvers 310 on either side thereof. Hinges 312 as well as intermediate hinge 322 extend vertically from the top to the bottom of spacer 320.

Figure 12:
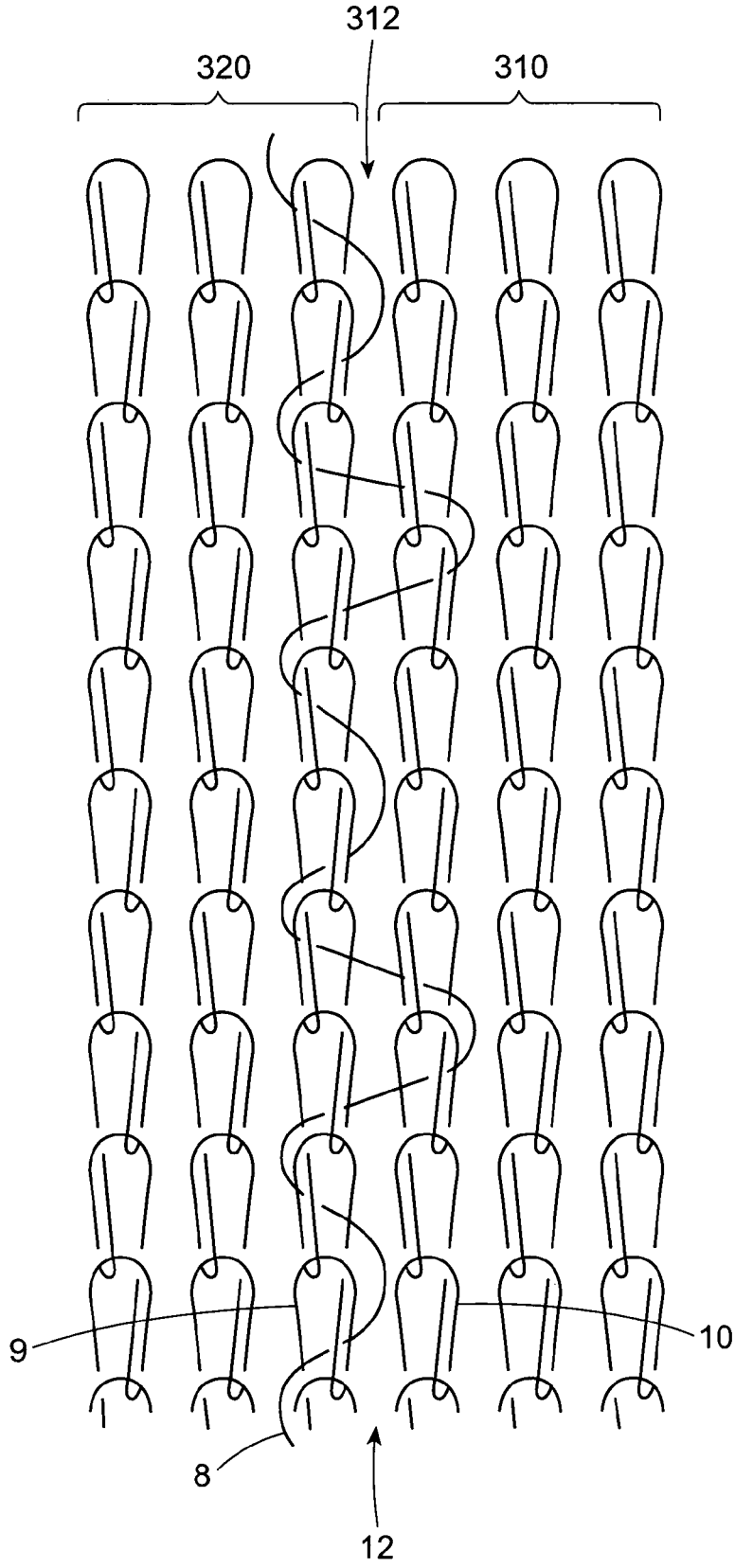
FIG. 12 is a schematic representation of the frangible hinge of the present invention.

FIG. 12 is a schematic representation of frangible hinge 312. Item 9 is a representation of the rightmost pillar stitch in the structure of spacer 320. The number of pillar stitches which comprise a spacer depend upon the width and appearance of the spacer, a typical number of stitches being about 25. However, there is no limitation on the number of pillar stitches which comprise a spacer for purposes of the present invention. For simplicity, only three pillar stitches in spacer 320 are illustrated. 10 represents the leftmost pillar stitch in louver 310, again only three pillar stitches of which are shown in FIG. 12. Connector yarn, 8 which forms the structure for hinge 312 traverses the edge pillar of spacer 320 and, where desired to form a connection, also traverses space 12 between spacer 320 and louver 310. The connector yarn is the only yarn that traverses this space. It is this arrangement that forms frangible hinge 312 along which the louvers and spacers fold.

Intermediate hinges 322 are preferably fabricated in the same manner, and are therefore similarly frangible. The placement of intermediate hinges 322 define the manner in which spacers 320 collapse when blind 300 is drawn. Therefore, the hinge 322 may be omitted entirely to produce a soft edge, or multiple hinges may be provided to produce a more accordion-like pattern.

The frequency and number of connections forming a frangible hinge can vary. This allows for adjustments to the strength of the connection, the flexibility of the hinge and incorporation of the hinge into the design.

The pillar stitches including 9 and 10 are preferably formed of a high tenacity yarn, whereas connector yarn 8 is preferably a yarn having a lower tenacity, thereby rendering hinge 312 frangible. The use of a lower tenacity yarn for connector yarn 8, preferably a filament yarn, provides the additional advantage of allowing a preferential folding direction or memory to be imparted onto the hinges. This can be accomplished by folding the hinges in a desired preferential direction and allowing them to remain in this position for a period of time, as in a package for delivery or sale.

Figure 13:
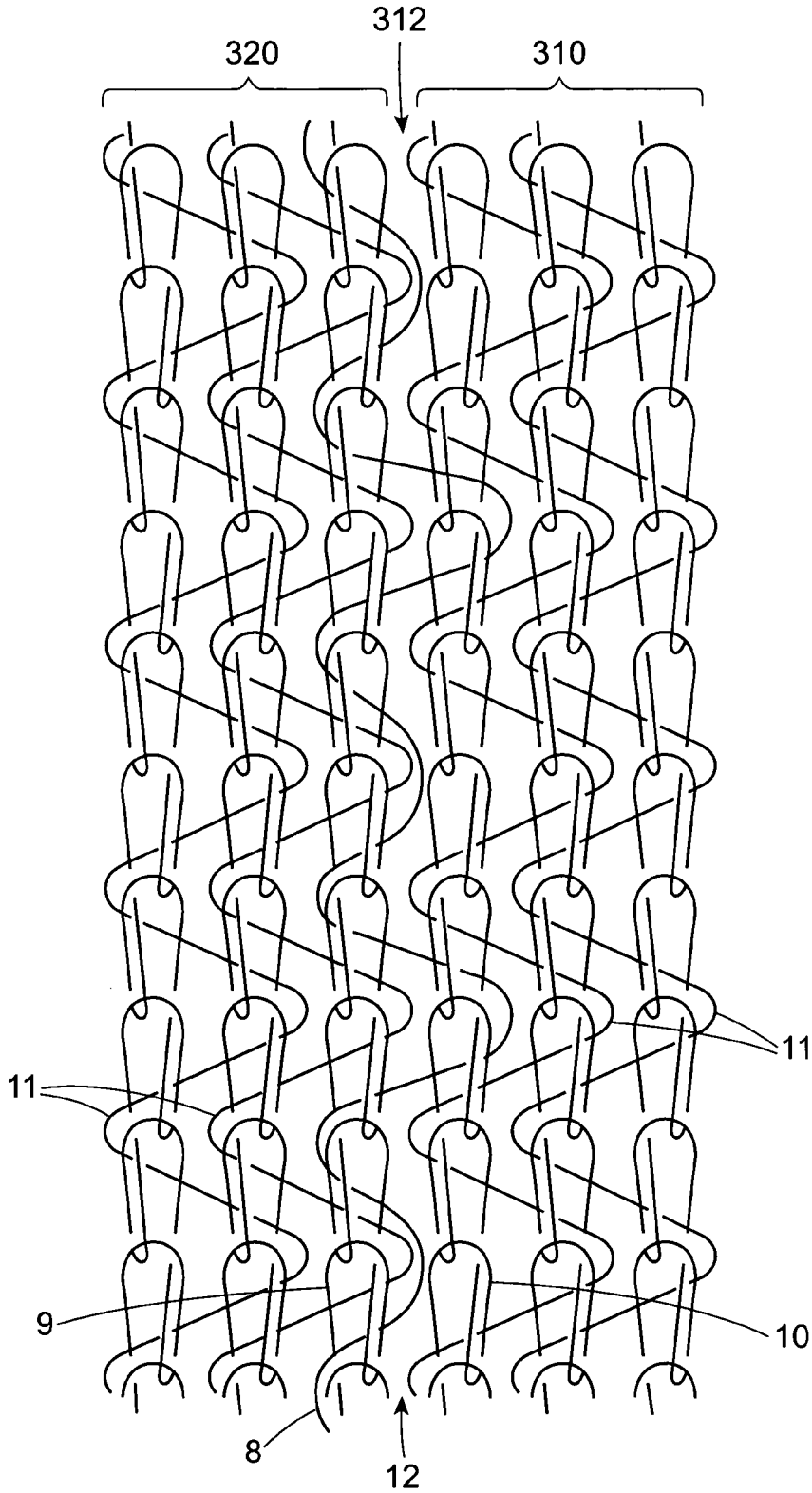
FIG. 13 is a schematic representation of the frangible hinge of the present invention.

FIG. 13 illustrates the same hinge mechanism as FIG. 12, however where FIG. 12 illustrates only the pillar stitches and a single connector yarn, FIG. 13 shows a preferred orientation of additional yarns 11 which traverse the pillar stitches of spaces 320 and louver 310 respectively. Yarns 11 increase the appearance of fabric structure, but do not traverse the space between spacer 320 and louver 310. It is only the connector yarn 8 that traverses this space. Therefore, similar to the tear away fringe disclosed in the previous embodiment, the structure of frangible hinge 312 is such that if the fabric was torn apart at space 12, the connector yarn would break permitting spacer 320 to separate from louver 310. As shown in FIGS. 12 and 13 connector yarn 8 is more intimately intertwined with pillar stitch 9 of spacer 320 and only incidentally intertwined with pillar stitch 10 of louver 310. This structure increases the likelihood that, upon tearing apart of louver 320 and spacer 310, the remnants of torn connector yarn 8 would remain embedded in spacer 320, leaving a clean edge on louver 310.

Because combination blind 300 is manufactured from a single panel, there is ideally a mechanism that allows the louvers 310 to rotate from an open to a closed position. Additionally, there is ideally a means by which the spacers 320 can collapse onto each other as the louvers are gathered together as the blind is drawn.

Therefore, frangible hinges 312 serve a dual purpose. First, the frangible hinges serve as a hinge member flexibly connect the louvers 310 to spacers 320 and permit relative movement between the louver and spacers while limiting any flexing of the fabric to the frangible hinges. As noted above, the selection of the type of yarn used for connector yarn 8 is preferably a type which is inherently more flexible than the yarns which are used to form the surrounding structure and pillar stitches. This applies equally to frangible intermediate hinges 322, which may be constructed in the same manner.

Figure 14:
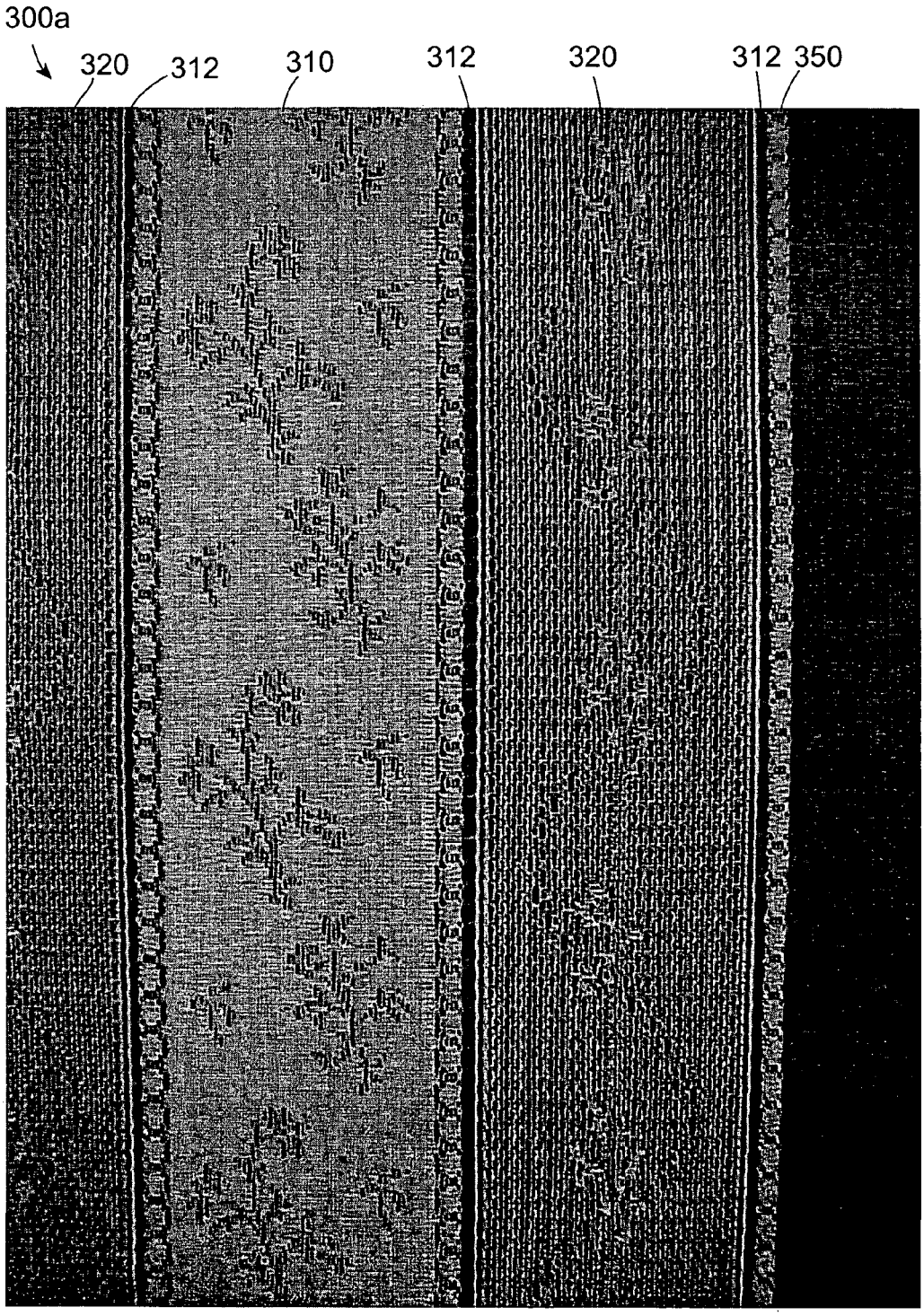
FIG. 14 is a partial plan view of a section of a combination blind.
Figure 15:
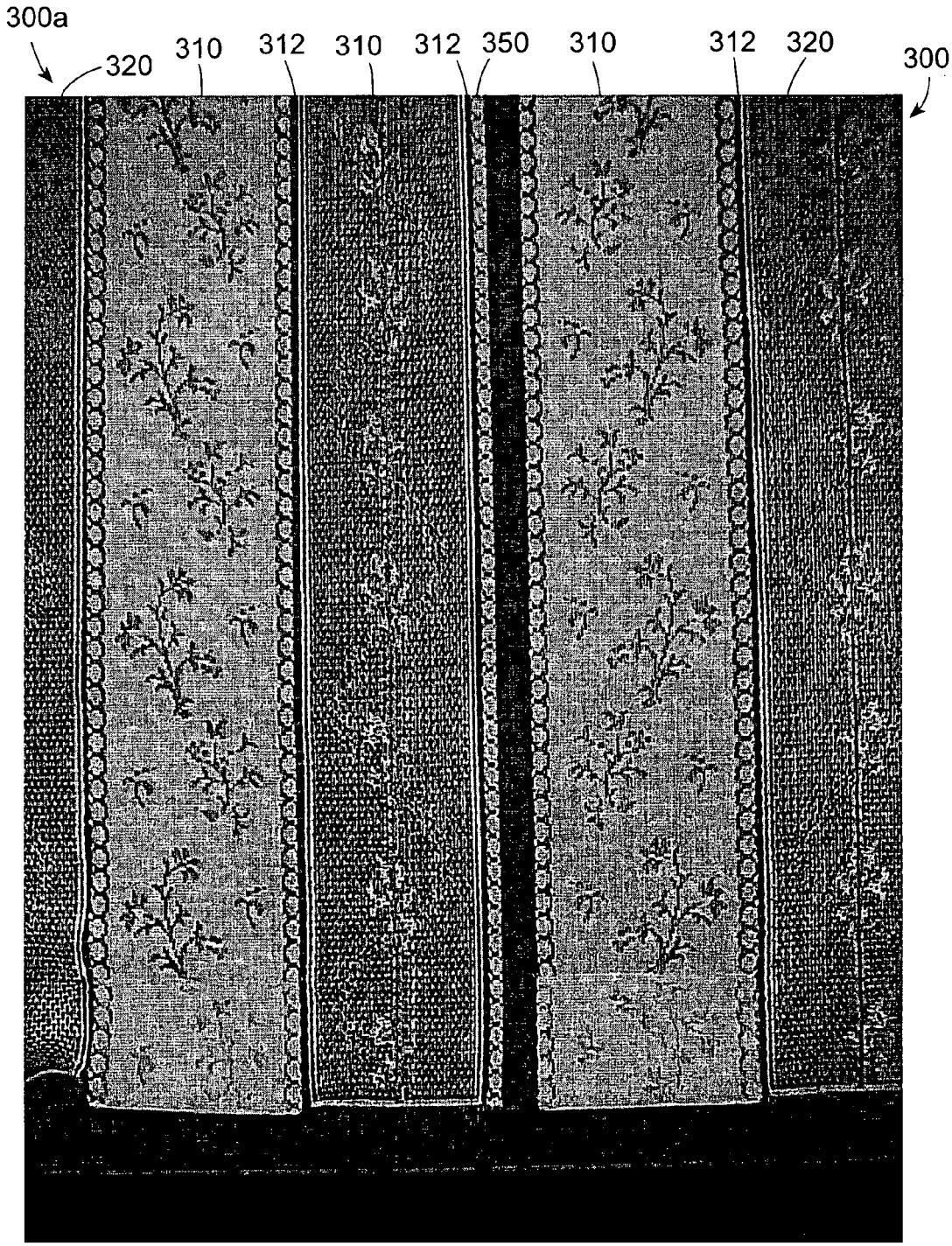
FIG. 15 is a partial plan view of two types of combination blinds incorporating the frangible hinge of the present invention.
Figure 16:
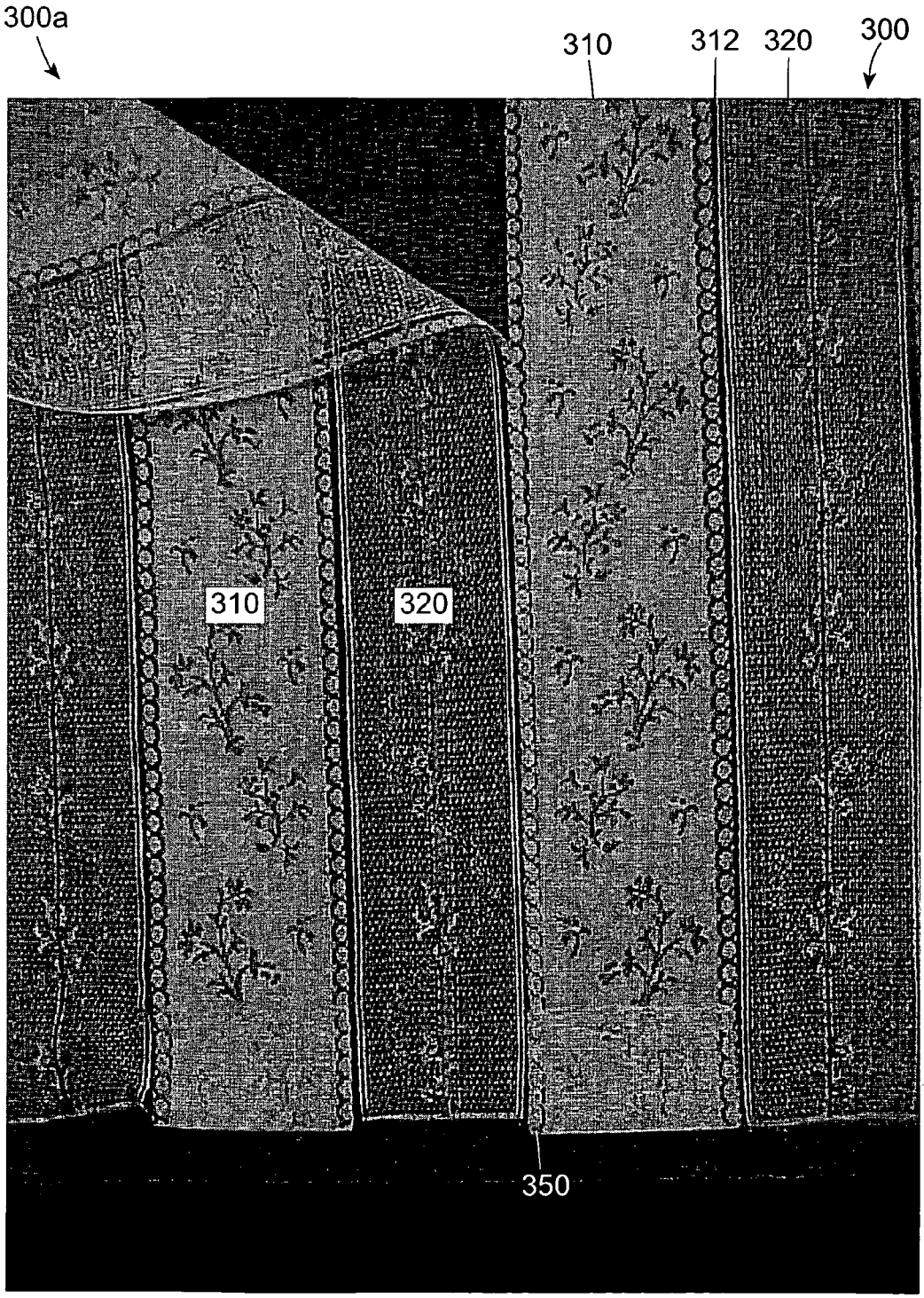
FIG. 16 is a partial plan view demonstrating the manner in which two combination blind panels of the present invention can be combined into a single combination blind.

The second function served by frangible hinges 312 is to permit part of the blind to be torn away without damaging any of its components. For example, when a blind fabricated in a single panel is too wide for a specific application, the excess louvers and spacers can be torn away, and discarded, the remaining blind having the desired width. The frangible hinges also permit the conversion of a combination blind into a conventional vertical blind, by simply tearing away each of spacers 320 from a single panel and discarding them, leaving a plurality of louvers 310 which would function in the same manner as the louvers of the vertical blind of the first embodiment. As shown in FIGS. 14-16, the design of combination blind 300 incorporates a number of fabric louvers 310 seamlessly connected together at frangible hinges 312 by sheer fabric spacers 320. Each blind panel 300, when manufactured, begins and ends in either a louver 310 or a spacer 320. As a result, two or more panels can be connected together, side by side, to accommodate a traverse of any length with any desired or required number of louvers. Thus, the combination blind panels are ideally manufactured in two versions. The first version 300 begins and ends with a louver 310 and is intended for any installation. The second version 300A begins and ends with a spacer 320. Attached to the outside edge of the end spacer 320 via a hinge 312 as previously described, will be a thin strip 350 of fabric that mimics the pattern along the edge of a louver 310.

The panels of a combination blind can be joined together in one of two ways. In a first way, a hot melt adhesive yarn will be knit into the fabric structure on the underside thin strip 350. Thin strip 350 may be layered on top of an edge of the end louver 310 of blind panel 300 and then heat may be applied (such as by the use of a conventional home iron) to melt the adhesive yarn to adhered thin strip 350 to the edge of louver 310 of blind panel 300. In a second way, a strip of hot melt adhesive film may be applied to the underside of thin strip 350. Thin strip 350 could be adhered to louver 310 of blind panel 300 by the adhesive film in a manner similar to that of the first method.

As shown in FIG. 14, blind panel 300A is shown having alternating louvers 310 and spacers 320 terminating in a spacer 320 which is connected to thin strip 350 by frangible hinge 312. As shown in FIG. 15, thin strip 350 of blind panel 300A is arranged adjacent to end louver 310 of blind panel 300.

FIG. 16 illustrates the alignment of thin strip 350 over the edge of louver 310 of blind panel 300. Adhering the panels together in this manner, frangible hinges 312 between end spacer 310 and thin strip 350 on blind panel 300A function in the same manner as the frangible hinges between the louvers and spacers of the remainder of the blind. Therefore, after blind panels 300A and 300 are joined at thin strip 350, the combined panels functions as a single vertical combination blind.

A wide variety of adhesives may be used to render thin strip 350 adhesive. For example, hot melt adhesive coated yarns, including part number 90×312116 produced by Engineered Yarns Company of Fall River, Mass. is a yarn provided with a polyamide hot melt coating suitable for adhering fabrics at a temperature between 280 and 300° F. Alternatively, a hot melt adhesive strip such as a transparent polyurethane, product number 3410 manufactured by Bemis of Shirely, Mass. is also suitable for adhering blind panel 300A. Other adhesives which are suitable for fabric will be known to a person of skill in the art to accomplish the same purpose.

The machinery used in the manufacture of the above vertical blind embodiment incorporating the frangible connection of the invention, in the most general terms is warp knitting machinery. Warp knitting is best defined as the creation of fabric from individual yarns by forming stitches along the direction of the warp. The stitches and yarns forming those stitches are continuous and run vertically through the fabric in the warp direction. This separates warp knitting from circular knitting, also known as weft knitting, where the stitches and yarns run horizontally through the fabric in the weft direction. Weaving is entirely different as there are no stitches and fabric is formed by interlocking warp yarns running vertically and weft yarns running horizontally in an over/under fashion.

More specifically, jacquard warp knitting machinery is preferably used in the production of the above described blinds. Jacquard warp knitting machinery allow the combination of fabric forming mechanics of warp knitting with pattern forming possibilities of the Jacquard patterning system. As will be obvious to a person of skill in the art, there are many different machine types within this group. Two that are most suitable for the production of these blinds are the Karl Mayer Model RJC 3/2F and the Karl Mayer Model RJCE 4/2F.

The Karl Mayer Model RJC 3/2F is a 3 bar, double jacquard, warp knitting machine. The gauge on this machine is 18 needles per inch, useful for production of "fine gauge" blinds, but it can be set to other gauges. The double jacquard feature offers the flexibility of 2 completely separate patterning mechanisms. One of the jacquard mechanisms is used only for decorative patterning. The other is used for both decorative patterning and the creation of the connectors in the frangible hinges and the tear away fringes disclosed above.

There are 3 separate bars that manipulate yarn for incorporation into the fabric. Two are the jacquard bars as mentioned above. The third is a bar that creates the pillar stitch. Different yarns can be loaded into each of the bar positions to create additional contrasts within the pattern.

Typically, jacquard bar 1 will be loaded with a relatively heavy yarn or a combination of heavy and light yarns, jacquard bar 2 will be loaded with a lighter yarn and the pillar bar, creating the base structure of the fabric, will be loaded with a yarn that meets the mechanical need of the fabric being manufactured.

The Karl Mayer Model RJCE 4/2F is a 4 bar double jacquard, warp knitting machine. The gauge on this machine is 9 needles per inch, useful for production of "coarse gauge" blinds, but it can be set to other gauges. The double jacquard feature offers the flexibility of 2 completely separate patterning mechanisms. One of the jacquard mechanisms is used only for decorative patterning. The other is used for both decorative patterning and the creation of the connectors in the frangible hinges and the tear away fringes.

There are 4 separate bars that manipulate yarn for incorporation into the fabric. Two are the jacquard bars as mentioned above. The third is a bar that creates the pillar stitch. The fourth is a bar that inlays a stabilizing yarn for added rigidity. Different yarns can be loaded into each of the bar positions to create additional contrasts within the pattern.

Typically jacquard bar 1 will be loaded with a relatively heavy yarn or a combination of heavy and light yarns, jacquard bar 2 will be loaded with a lighter yarn and the pillar and stabilizing bars, creating the base structure of the fabric, will be loaded with a yarn that meets the mechanical need of the fabric being manufactured.

Many different combinations of yarns for the manufacture of these blinds are possible, and would be obvious to a person of skill in the art. One yarn combination used on an RJC 3/2F machine is as follows:

Jacquard Bar 1: 300 denier, 68 Filament, Semi Dull, Textured Polyester. This is a heavy yarn used to create bold pattern designs and to impart opacity to the blind louvers.

Jacquard Bar 2: 50 Denier, 24 Filament, Semi Dull, Filament Polyester, Regular Tenacity. This is a lighter yarn used to create some pattern effects as well as the connectors for the frangible hinges and tear away fringes. The critical specification of this yarn is its tensile strength which is lower than the yarns used to create the pillar stitches.

Bar 3: 70 Denier, Semi Dull, Textured Polyester, High Tenacity. This is the yarn used to form the pillar stitches which are the base structure for the fabric. High tenacity yarn is used to increase the strength and assure that the structure of the fabric is not damaged when the louvers are separated.

A second yarn combination, used on a RJCE 4/2F machine, is as follows: Jacquard Bar 1, Top: 150 Denier, 50 Filament Polyester. This is a medium yarn which is used in conjunction with other yarns to create contrasting bold pattern effects and impart opacity to the blind louvers.

Jacquard Bar 1, Bottom: 3 Ply, 150 Denier, 34 Filament Polyester. This is very heavy yarn used in conjunction with the yarn in jacquard bar 1, top above.

Jacquard Bar 2: 70 Denier Polyester, Regular Tenacity. This is a lighter yarn used to create some pattern effects as well as the connectors for the frangible hinges and tear away fringes.

Bar 3: 70 Denier, Semi Dull, Textured Polyester, High Tenacity. This is the yarn used to form the pillar stitches which are the base structure for the fabric. High tenacity yarn is used to increase the strength and to assure that the structure is not damaged when the louvers are separated.

Bar 4: 70 Denier, Semi Dull, Textured Polyester, High Tenacity. This yarn is used as a stabilizer to add rigidity to the fabric.

Yarn tenacity is defined as the maximum load that can be applied to a yarn before breaking, expressed in grams per denier. When comparing polyester yarns of different deniers, the thicker yarn (higher denier) will be stronger. But, since the tenacity is expressed in grams per denier, they may have the same tenacity rating. It is for this reason, for the intent of having one yarn be stronger than another, that tenacity is only important if the two yarns are of relatively the same denier. Below is a comparison of two 70 denier polyester yarns from the same supplier, one regular tenacity and one high tenacity. These data were copied from test results and yarn specifications provided by the yarn manufacturer, Dillon Yarn Corporation of Patterson, N.J. The high tenacity version has a 22.7% increase in tenacity over the regular version.

| | ITEM | |
|---|---|---|
| | 1/70/36 Regular Polyester | 1/70/34 High Tenacity Polyester |
| Actual Denier | 76.8 | 66.5 |
| Tenacity Grams/Denier | 4.97 | 6.10 |
| Elongation | 24.4% | 17.63% |
| Breaking Strength, Grams | 381.7 | 405.6 |

It will be appreciated from the above noted description of various arrangements of embodiments of the present invention, that a frangible connection in a form of hinge or a tear away fringe has been described which is employed in the production of vertical blinds from single panels of fabric. It will also be appreciated that the features described in connection with each arrangement of the invention are interchangeable to some degree so that many variations beyond those specifically described are possible. For example, fabric panels incorporating components other than those for vertical blinds may also be frangibly connected by the present invention as disclosed herein.

Although the present invention has been described to a certain degree of particularity, it is understood that the present disclosure has been made by way of example, and changes in detail or structure may be made without departing from the spirit of the invention.

What is claimed is:

1. A vertical blind panel comprising:

a plurality of substantially opaque fabric louvers and a plurality of sheer transparent or translucent fabric spacers, each of the plurality of fabric spacers being arranged between a respective pair of the plurality of fabric louvers, each of the plurality of fabric louvers and fabric spacers having pillar stitches on lateral edges thereof, each pillar stitch having a tensile strength, at least one of the plurality of fabric louvers connected to an adjacent one of the plurality of fabric spacers by a frangible fabric connection, the frangible fabric connection comprising:

at least one connector yam alternately traversing from the pillar stitches of the at least one of the plurality of fabric louvers to the pillar stitches of the adjacent one of the plurality of fabric spacers and from the pillar stitches of the adjacent one of the plurality of fabric spacers to the pillar stitches of the at least one of the plurality of fabric louvers, the at least one connector yarn having a tensile strength less than that of the pillar stitches traversed by the connector yarn, such that the at least one of the plurality of fabric louvers may be separated from the adjacent one of the plurality of fabric spacers by applying tensile force to the connector yarn causing the connector yarn to break without damage to the pillar stitches.

2. The vertical blind panel of claim 1, wherein each of the plurality of fabric louvers is provided with indicia indicating the location and orientation of fold and sew points in the louvers.

3. The vertical blind panel of claim 1, wherein each of the plurality of fabric louvers is provided with indicia indicating the location and orientation of a mounting fold.

4. The vertical blind panel of claim 1, wherein the panel is formed of a knitted textile in a single knitting operation on a single knitting machine.

5. The vertical blind panel of claim 4, wherein each one of the plurality of fabric louvers and fabric spacers has a knitted structure which is independent without interknitting between any louvers other than that provided by the connector yarn.

6. A vertical blind panel comprising:

a single sheet of material formed in a single sewing operation, comprising:

a plurality of substantially opaque louvers;

a plurality of sheer transparent or translucent spacers, each of the plurality of spacers disposed between a respective pair of the plurality of louvers; and a plurality of first frangible hinges, each one of the plurality of first frangible hinges disposed between a respective one of the plurality of louvers and an adjacent one of the plurality of spacers.

7. The vertical blind panel of claim 6, further comprising a plurality of second frangible hinges disposed within each one of the plurality of spacers.

8. The vertical blind panel of claim 6, wherein each of the plurality of first frangible hinges comprises at least one connector yarn alternately traversing between pillar stitches of a respective one of the plurality of louvers and pillar stitches of an adjacent one of the plurality of spacers, the at least one connector yarn having a tensile strength less than that of the pillar stitches traversed by the connector yarn.

9. The vertical blind panel of claim 7, wherein each of the plurality of second frangible hinges comprises at least one connector yarn alternately traversing between pillar stitches of a first part of a respective one of the plurality of spacers and pillar stitches of a second part of the one of the plurality of spacers, the at least one connector yarn having a tensile strength less than that of the pillar stitches traversed by the connector yarn, the plurality of second frangible hinges allowing the plurality of spacers to collapse when the vertical blind panel is disposed in an open position.

10. The vertical blind panel of claim 6, wherein one of the plurality of spacers forms a lateral end of the vertical blind panel, and a strip of louver material is disposed vertically along an outer edge of the one of the plurality of spacers, such that the strip of louver material can be adhered to a louver of another vertical blind panel to form a combination vertical blind structure.

11. The vertical blind panel of claim 10, wherein the strip of louver material is attached to the one of the plurality of spacers by a frangible hinge.

12. A vertical blind panel comprising:

alternating substantially opaque fabric louvers having lateral edges and sheer transparent or translucent fabric spacers, each one of the spacers extending between a respective spaced apart pair of the louvers, the spacers and the louvers being attached by frangible fabric connections;

means for pivotably supporting the louvers so their lateral edges are in a vertical orientation;

means for causing pivotal movement of the louvers between:

(i) a closed orientation wherein the louvers are generally parallel to one another and in a common plane, with the lateral edges of each louver being closely adjacent the lateral edges of adjacent louvers, thereby to at least partially block the passage of light through the panel; and (ii) an open orientation wherein the louvers are generally transverse to the common plane and parallel to one another, the spacers extending generally between the louvers within the common plane, thereby to filter light passing through the panel between the louvers; and means for laterally moving the supporting means, and hence the louvers when the louvers are in the open orientation, toward at least one side of the panel, thereby to cause the spacers to at least partially collapse or fold over, wherein the frangible fabric connections can be torn to separate the spacers from the louvers without damage to either the spacers or the louvers.

13. The vertical blind panel of claim 12, further comprising a means for attaching the panel to a second panel such that the attached panels function together as a single panel.

* * * * *